US007069604B2

(12) United States Patent
Tomita et al.

(10) Patent No.: US 7,069,604 B2
(45) Date of Patent: Jul. 4, 2006

(54) TANKLESS WESTERN-STYLE FLUSH TOILET

(75) Inventors: Katsunori Tomita, Aichi (JP); Kenichi Ito, Aichi (JP); Koji Miwa, Aichi (JP); Shingo Morikawa, Aichi (JP); Yasuhiro Shirai, Aichi (JP); Masataka Mizutani, Aichi (JP); Shoichi Nakamura, Aichi (JP); Hideya Koike, Aichi (JP); Hidefumi Toyoshi, Aichi (JP); Atsushi Itoh, Aichi (JP)

(73) Assignee: INAX Corporation, Tokoname (JP)

( * ) Notice: Subject to any disclaimer, the term of this patent is extended or adjusted under 35 U.S.C. 154(b) by 0 days.

(21) Appl. No.: 10/910,629

(22) Filed: Aug. 4, 2004

(65) Prior Publication Data

US 2005/0015871 A1 Jan. 27, 2005

Related U.S. Application Data

(62) Division of application No. 10/311,899, filed as application No. PCT/JP01/00900 on Feb. 8, 2001, now Pat. No. 6,823,535.

(30) Foreign Application Priority Data

| | | |
|---|---|---|
| Jun. 23, 2000 | (JP) | 2000/190024 |
| Jun. 30, 2000 | (JP) | 2000/198235 |
| Jul. 11, 2000 | (JP) | 2000/209677 |
| Jul. 19, 2000 | (JP) | 2000/218499 |
| Aug. 4, 2000 | (JP) | 2000/237381 |

(51) Int. Cl.
*E03D 5/10* (2006.01)

(52) U.S. Cl. ..... 4/406; 4/405; 4/421; 4/422

(58) Field of Classification Search ..... 4/406, 4/407, 302, 304, 305, 420, 421–423, 425; 137/327; 251/37, 40, 42, 44, 120
See application file for complete search history.

(56) References Cited

U.S. PATENT DOCUMENTS

| | | | |
|---|---|---|---|
| 2,046,004 | A | 6/1936 | Sloan |
| 2,271,047 | A | 1/1942 | Sloan |

(Continued)

FOREIGN PATENT DOCUMENTS

| | | |
|---|---|---|
| DE | 123 866 | 12/1900 |

(Continued)

*Primary Examiner*—Tuan Nguyen
(74) *Attorney, Agent, or Firm*—Oblon, Spivak, McClelland, Maier & Neustadt, P.C.

(57) ABSTRACT

The present invention provides an open/close valve which contributes the stabilization of the operation responsibility. A housing has a water-in port and a water-out port. Furthermore, a piston which is slidably mounted in the housing in an axial direction by means of an external operation of a shaft, and a pressure offset means for offsetting the pressure which the piston receives from water in the water-out port to the other side are provided. The piston is attached to a seat face of the housing by being slided on one side in an axial direction to close the communication between the water-in port and the water-out port, and the piston is detached to the seat face of the housing by being slided on the other side in an axial direction to open the communication between the water-in port and the water-out port. The pressure offset means comprises a pressure offset room which is formed at the other side of the piston, and a passage for communicating one side of the piston with the pressure offset room.

4 Claims, 18 Drawing Sheets

U.S. PATENT DOCUMENTS

| | | | | |
|---|---|---|---|---|
| 2,786,210 | A | 3/1957 | Fraser | |
| 3,324,481 | A | 6/1967 | Emerson et al. | |
| 3,908,204 | A | 9/1975 | Hopkins | |
| 5,125,621 | A * | 6/1992 | Parsons et al. | 4/406 |
| 5,224,685 | A * | 7/1993 | Chiang et al. | 4/304 |
| 5,228,146 | A | 7/1993 | Martell | |
| 6,018,827 | A * | 2/2000 | Shaw et al. | 4/406 |
| 6,349,921 | B1 * | 2/2002 | Jahrling | 4/406 |
| 6,584,623 | B1 | 7/2003 | Grech et al. | |
| 2003/0088910 | A1 | 5/2003 | Hidetaka et al. | |
| 2003/0101509 | A1 | 6/2003 | Noburu et al. | |

FOREIGN PATENT DOCUMENTS

| | | |
|---|---|---|
| DE | 251 321 | 12/1911 |
| DE | 596 150 | 4/1934 |
| DE | 1 007 257 | 4/1957 |
| EP | 0 352 712 | 1/1990 |
| JP | 68578 | 3/1926 |
| JP | 50-26426 | 3/1975 |
| JP | 53-141746 | 11/1978 |
| JP | 54-51622 | 4/1979 |
| JP | 58-28951 | 2/1983 |
| JP | 61-129975 | 8/1986 |
| JP | 1-192924 | 8/1989 |
| JP | 1-299930 | 12/1989 |
| JP | 2-5854 | 2/1990 |
| JP | 2-78878 | 6/1990 |
| JP | 3-90723 | 4/1991 |
| JP | 3-90747 | 4/1991 |
| JP | 3-092747 | 4/1991 |
| JP | 3-157582 | 7/1991 |
| JP | 3-253630 | 11/1991 |
| JP | 3-253632 | 11/1991 |
| JP | 4-106233 | 4/1992 |
| JP | 4-118432 | 4/1992 |
| JP | 04-118432 | 4/1992 |
| JP | 9-165808 | 6/1997 |
| JP | 2669044 | 7/1997 |
| JP | 9-316975 | 12/1997 |
| JP | 2758664 | 3/1998 |
| JP | 2814644 | 8/1998 |
| JP | 11-303182 | 11/1999 |
| JP | 2000-309968 | 11/2000 |
| JP | 2000-309969 | 11/2000 |
| JP | 2000-309974 | 11/2000 |
| JP | 2001-26961 | 1/2001 |
| JP | 2001-73434 | 3/2001 |
| JP | 2001-81827 | 3/2001 |

* cited by examiner

TANKLESS WESTERN-STYLE FLUSH TOILET

TECHNICAL FIELD

First invention relates to a western-style flush toilet having a manual handle which is able to wash a toilet body due to fluctuation. Second and third inventions relate to a flush toilet.

BACKGROUND ART

In a common western-style flush toilet, water which is supplied from a water supply source such as a city water service pipe and so on is temporarily reserved in a toilet washing tank such as a low tank and so on, and a western-style toilet body is washed by the water which is reserved in the toilet washing tank. The toilet washing tank is mounted at a rear portion of the western-style toilet body or on a side wall of a toilet room in such a manner that the toilet washing tank is positioned outside the western-style toilet body. Furthermore, the toilet washing tank has a large volume in order to spout a large amount of water into the western-style toilet body at one time for ensuring the discharge of filth from the western-style toilet body. However, in such a common western-style flush toilet, a space is required for mounting the toilet washing tank. Accordingly, recently, from the viewpoint of effectively making use of the space, a tankless western-style flush toilet in which an open/close vale (valve for adjusting a flow amount) is mounted between a water supply source and a western-style flush toilet, and which is capable of directly supplying water that is supplied from the water supply source by opening the open/close valve to the western-style flush toilet has been developed (Japanese Patent Laid-open No. 90723/1991, Japanese Patent Registration No. 2841537).

In this tankless western-style flush toilet, a toilet washing water supply device which washes a western-style toilet body with water that is directly supplied from a water supply source is mounted in the western-style toilet body, and the water is directly supplied to the western-style toilet body by opening an open/close valve which is contained in the toilet washing water supply device. In the toilet washing water supply device, the open/close valve has a water-in port as an inlet port and a water-out port as an outlet port at a housing, and at the same time, a valve mechanism which is able to adjust the divergence between the water-in port and the water-out port. The water-in port is connected to the water supply source to be capable of taking water into the housing, and the water-out port is connected to the western-style toilet body to be capable of spouting water from the housing to the western-style toilet body. Furthermore, the open/close valve has a diaphragm as a valve mechanism between the water-in port and the water-out port, and the diaphragm can be bent flexibly by the operation of an electromagnetic valve which is driven by the on-off operation. Accordingly, in this toilet washing water supply device, the diaphragm is bent flexibly by the operation of the electromagnetic valve, and hence, the divergence of the communication between the water-in port and the water-out port can be adjusted.

Moreover, in the open/close valve of the tankless western-style flush toilet, a rim flow passage such as a rim conduit and the like for supplying water to a rim channel which is mounted at an upper portion of a toilet bowl of the western-style toilet body, and a jet flow passage such as a jet conduit and the like for supplying water to a jet hole which generates a forced siphon effect and which is mounted at a bottom portion of the toilet bowl are formed. Then, the open/close valve carries out the rim water-through operation in which water is supplied to the rim flow passage to wash an inner wall surface of the toilet bowl with water which flows down from the rim channel, and the open/close valve carries out the jet water-through operation in which water is supplied to the jet flow passage to spout the water from the jet hole in the inside of the toilet bowl at high speed, and as a result, a forced siphon effect is generated to discharge filth which is excreted in the toilet bowl. Such a rim flow passage and such a jet flow passage are separate paths which are independent from each other. In the above-mentioned tankless western-style flush toilet, there exists a possibility that a negative pressure is generated at an upstream side of the rim flow passage and the jet flow passage to generate a back flow of filth water after the open/close valve which is in the open condition for supplying water is closed to stop supplying water to the rim channel or the jet hole. Accordingly, in such a tankless western-style flush toilet, a vacuum breaker which is communicated with an air is formed at the rim flow passage and the jet flow passage respectively in order to prevent a back flow of filth water.

In addition, in a forced siphon toilet as a tankless western-style flush toilet, the time for supplying water to the rim flow passage and the jet flow passage is controlled by a flow passage switching device in such a manner that each time doesn't overlap with each other. FIG. 20 shows one example of a forced siphon toilet 1 having such kind of flow passage switching device. In this flow passage switching device, two branch water supply pipes Q and R are connected by way of a constant flow amount valve L at the middle of a main water supply pipe P which is connected to a water supply source, and an open/close valve M, N is mounted in each branch water supply pipe Q, R. At the same time, one branch water supply pipe Q is connected to a rim channel 2, and the other branch water supply pipe R is connected to a jet hole 5 which is mounted at the bottom portion of a toilet bowl 4. In such a conventional flow passage switching device, in order to carry out the washing of the forced siphon toilet 1, at first, only one open/close valve M is opened to supply water from the branch water supply pipe Q to the side of the rim channel 2, thereby washing the toilet bowl 4. Then, the open/close valve M is closed, and the other open/close valve N is opened to spout water from the jet hole 5 to a discharge pipe 3 by way of the branch water supply pipe R. Due to this, the discharge pipe 3 is rapidly filled with water, so a siphon effect is swiftly generated. When water is discharged and the siphon effect is finished, the open/close valve N is closed to stop supplying water to the branch water supply pipe R on the side of the jet hole 5, and at the same time, the open/close valve M is again opened to supply water from the branch water supply pipe Q on the side of the rim channel 2 to the toilet bowl 4, thereby forming sealing water in the forced siphon toilet 1.

In an open/close valve for a flush toilet having a valve mechanism in a housing, a water-in port, a water-out port and a communication passage are formed in the housing. The communication passage communicates the water-in port with the water-out port, and the communication passage can be opened and closed by the valve mechanism. In the open/close valve for a flush toilet, as above-mentioned, when the valve mechanism opens the communication passage, water which is taken from a water supply source by way of the water-in port is spouted to a western-style toilet body by way of the water-out port, and accordingly, it is possible to wash the western-style toilet body. When the washing of the western-style toilet body is finished, the valve mechanism closes the communication passage, and spouting water to the western-style toilet body is finished.

Moreover, normally, a manual handle is mounted on a toilet washing tank in such a manner that the manual handle can be fluctuated. If the user fluctuates the manual handle by the manual operation, a chain which is dragged by the manual handle lifts up a valve which is mounted at the bottom of the toilet washing tank to be the released condition. Due to this, water in the toilet washing tank is supplied to the western-style toilet body, and the western-style toilet body is washed. Accordingly, when the manual handle is fluctuated by the manual operation, the manual handle should be fluctuated against water pressure which acts on the valve. Such an operation requires some physical strength, so the manual handle doesn't have necessarily an excellent operability for a serious patient or an old man whose physical strength is considerably weak. Accordingly, recently, a western-style flush toilet in which an electric motor for driving a manual handle automatically is mounted on a toilet washing tank, and at the same time, a toilet washing switch is mounted on a toilet wall which is apart from a western-style toilet body in such a manner that the toilet washing switch is independent from the manual handle separately has been developed. In this western-style flush toilet, after relieving oneself, if the user who is a part from the western-style toilet body carries out the push operation of the toilet washing switch at the toilet wall, the electric motor is driven to flactuate the manual handle automatically, and the washing of the western-style toilet body is carried out. In this case, the push operation of the toilet washing switch doesn't require much physical strength, so an excellent operability can be exhibited.

Furthermore, in the above tankless western-style flush toilet, at the time of washing a western-style toilet body, it is possible to select a water supply amount depending on whether or not a drainpipe which is connected to a trap of a western-style toilet body is an underfloor discharging construction or a floor discharging construction. Therefore, the time for releasing an open/close valve is maintained in accordance with the discharging construction, and the effective washing of the western-style toilet body can be carried out by an appropriate amount of water supply.

DISCLOSURE OF THE INVENTION

{First Invention}

However, in the above western-style flush toilet, a toilet washing switch is mounted on the toilet wall which is apart from the western-style toilet body in such a manner that the toilet washing switch is separated from the manual handle. So, if the user is not accustomed to such a western-style flush toilet, there is the case that he doesn't notice the existence of the toilet washing switch. In this case, although the toilet washing switch and the like are existed, the user carries out the manual operation on the manual handle, and as a result, an advantage in the operability is not satisfactorily exhibited.

Especially, the present inventors consider advantages such as an arrangement space and the like recently, and they are now developing a tankless western-style flush toilet having no toilet washing tank. The tankless western-style flush toilet has a toilet washing device which is able to wash a western-style toilet body with water that is directly supplied from a water supply source. So, the manual handle is not required in the sense of supplying water in the conventional toilet washing tank, it is considered that the user who is not accustomed to such a tankless western-style flush toilet is further puzzled.

Furthermore, as the toilet washing device in such a tankless western-style flush toilet, the one having an open/close valve for supplying water and stopping water supply between the water supply source and the western-style toilet body, a cam device for opening and closing the open/close valve and an electric motor which is able to operate the cam device by means of the operation of the toilet washing switch by the user is adopted. In this case, it is effective that the manual handle for rotating the cam device manually is also mounted preliminarily for an emergency such as power failure and the like. If it is not in case of power failure, there is high possibility that the user who is not accustomed to such a tankless western-style flush toilet misunderstands that the manual handle is served for washing the western-style toilet body. In this case, much physical strength is required for operating the cam device manually by the manual handle, and there is a fear that the user has a heavy operation feeling in his mind.

The first invention has been made in view of the above circumstances and it is the first task to be solved to provide a western-style flush toilet which is able to wash a western-style toilet body with an excellent operability by the user who is not accustomed to the western-style flush toilet.

With respect to the western-style flush toilet of the first invention, in a western-style flush toilet which has a western-style toilet body, an open/close valve and a manual handle, and which releases the open/close valve by fluctuation of the manual handle, the improvement is characterized in that a detection means for detecting the contact or a very small angle deviation is mounted on the manual handle, and that at least the release of the open/close valve is assisted by a detection signal of the detection means.

In the western-style flush toilet of the first invention, even if the user is not accustomed to the western-style flush toilet, and when the user doesn't notice the existence of the toilet washing switch, only if the user operates the manual handle lightly, the detection means detects that the user touches the manual handle lightly or that the manual handle makes a very small angle deviation. Due to this, the release of the open/close valve is assisted, and the washing of the western-style toilet body is carried out.

In the western-style flush toilet of the first invention, it is preferable that the manual handle is assisted to be fluctuated by the detection signal of the detection means. With such a constitution, even if the user is not accustomed to the western-style flush toilet, he notices the fluctuated manual handle visually and acoustically, so he doesn't rotate the manual handle by not more physical strength than that is needed. Therefore, it is possible to prevent malfunction and failure which are caused by the fact that the user rotates the manual handle by force.

In the western-style flush toilet of the first invention, it is preferable that the user is able to know the time when the manual handle is assisted. With such a constitution, it is possible to prevent the user from rotating the manual handle by not more physical strength than that is needed. Furthermore, as the means that the user is able to know the time when the manual handle is assisted, it is possible to adopt the one in which a noise such as an intermittent electronic noise is generated, a light is flashed and the like.

In the western-style flush toilet of the first invention, when it has a toilet washing device which has no toilet washing tank, and in which water is directly supplied from a water supply source and the water is supplied from a released open/close valve to be able to wash a western-style toilet body, it is preferable that a manual handle is mounted on the toilet washing device. With such a constitution, the user who is not accustomed to the western-style flush toilet is not puzzled.

Moreover, as the toilet washing device of such a tankless western-style flush toilet, when the one having an open/close valve for supplying water and stopping water supply between the water supply source and the western-style toilet body, a cam device for opening and closing the open/close valve and an electric motor which is able to operate the cam device by means of the operation of a toilet washing switch by the user is adopted, if a manual handle for rotating the cam device manually is also mounted preliminarily for an emergency such as power failure and the like, it is preferable that a detection means is mounted on the manual handle, and that at least the release of the open/close valve is assisted by a detection signal of the detection means. With such a constitution, although some physical strength is required at the time of an emergency such as power failure and the like, it is possible to wash the western-style toilet body by the manual handle. Furthermore, in case of not power failure, it is possible to prevent the user who is not accustomed to the western-style flush toilet from having a heavy operation feeling in his mind.

Furthermore, the western-style flush toilet of the first invention can be adopted to a tank-type western-style flush toilet having a toilet washing tank in which water that is supplied from a water supply source such as a city water service pipe and the like is temporarily stored before the water is flown into a western-style toilet body. In this case, it may have a constitution in which a detection means is mounted on a manual handle which is mounted on an outer surface of the toilet washing tank, and in which at least the release of an open/close valve is assisted by a detection signal of the detection means.

It is possible that the detection means is constituted by a sensor for detecting that the user touches the manual handle or that the manual handle makes a physical deviation. As such a sensor, it is possible to adopt a pressure sensitive sensor for detecting that the user touches the manual handle, a torque sensor for detecting a torque at the time of the initial operation of the manual handle by the user and a light sensor in which the initial operation of the manual handle by the user is detected by a light. As the light sensor, for example, it is possible to adopt a photo interrupter which includes a luminous element and a light-receiving element, and which detects the existence of an obstruction (manual handle) between the luminous element and the light-receiving element.

In order to assist fluctuation of the manual handle based on the detection signal of the detection means, it is possible to adopt a driving device and a controller. The driving device is served to release the open/close valve, and it is able to have an electric motor for releasing the open/close valve. For example, the driving device can adopt the one having a cam device for opening and closing the open/close valve in order to supply water and stop supplying water to the western-style toilet body, and an electric motor for operating the cam device. Furthermore, the controller is served to operate the driving device based on the detection signal of the detection means, and it can be constituted by a circuit having CPU.

{Second Invention}

Furthermore, in the conventional flush toilet, the open/close valve becomes the abnormal condition due to mischief or failure of the toilet washing device. If such an abnormal condition is left alone, water is left to flow, and water is wastefully consumed.

The second invention has been made in view of the above circumstances and it is the second task to be solved to provide a flush toilet in which water is not wastefully consumed.

With respect to the flush toilet of the second invention, in a flush toilet having a toilet body and a toilet washing device which is able to wash the toilet body with water, and which has an open/close valve that is able to spout the water by being opened and closed electrically, the improvement is characterized in that the toilet washing device has a detection means for detecting the abnormal condition of the open/close valve, and a return means for making the open/close valve in the closed condition based on an abnormal signal of the detection means.

In the flush toilet of the second invention, even if the open/close valve becomes the abnormal condition, the abnormal signal is generated by the detection means, and the open/close valve is in the closed condition by the return means automatically.

In the flush toilet of the second invention, it is preferable that the toilet washing device has a notice means for notifying the abnormal condition based on the abnormal signal of the detection means. With such a constitution, the user is able to know that there is something abnormal in the toilet washing device, and it is possible to take measures to meet this rapidly.

As the detection means, it is possible to adopt a position sensor, a flow amount sensor, a water pressure sensor and the like. Furthermore, as the notice means, it is possible to adopt an apparatus for generating, for example, an electric noise, and an apparatus for flashing a luminous diode and the like.

Furthermore, in the flush toilet of the second invention, it is preferable that the return means makes the open/close valve in the closed condition after carrying out at least a water sealing treatment on the toilet body. With such a constitution, even if the open/close valve is in the abnormal condition, a water sealing treatment is carried out in the trap, and it is possible to prevent a nasty smell from going up through a drain pipe.

In this case, the return means is able to make the open/close valve in the closed condition after carrying out the normal washing treatment on the toilet body. With such a constitution, even if the open/close valve is in the abnormal condition, the normal washing treatment is carried out at least once on the toilet body, and the washing of the toilet body is surely carried out. Accordingly, filth is not remained, and the generation of an unpleasant smell is prevented, and the flush toilet becomes sanitary.

Moreover, in the flush toilet of the second invention, it is preferable that the return means makes the open/close valve in the closed condition at the time of exceeding a constant frequency of retry. With such a constitution, even if it is impossible to carry out the normal washing treatment on the toilet body due to the abnormal condition of the open/close valve, the retry is not repeated endlessly, and finally, water is not left to flow. Accordingly, waste consumption of energy is prevented, and waste consumption of water is also prevented.

As the open/close valve, it is possible to adopt the one which is driven by a stepping motor. With such a constitution, the detection means is able to detect the condition of the open/close valve by means of the frequency of pulse which corresponds to a rotation angle of the stepping motor. Due to this, it is possible to control the open/close valve based on a pulse signal easily, and at the same time, it is possible to detect the present condition of the open/close valve easily.

{Third Invention}

Furthermore, in the conventional flush toilet, during the winter season, an intention of a control person who tries to prevent the damage which is caused by freezing water that is reserved in the open/close valve is incompatible with the use of the conventional flush toilet under the control of the control person.

Namely, during the winter season, if the open/close valve is maintained in the fully-closed condition, the reserved water that is reserved in the open/close valve is frozen, and there is a fear that the open/close valve is damaged. In order to prevent this, the control person may close a city water service pipe for supplying water to the open/close valve by a stop cock under the ground, and at the same time, he may discharge the reserved water in the open/close valve to an upstream side or a downstream side by making the open/close valve the semi-opened condition, namely, water is drained away.

However, although the control person drains water away, there is a case that the user opens the stop cock again and that he operates a washing switch of the toilet washing device. In this case, if the open/close valve is maintained and stopped in the closed condition after carrying out a series of open/close operations of the open/close valve for washing the western-style toilet body, it is canceled that the control person drains water away after the user uses the flush toilet. As a result, the effect for preventing the freezing of the open/close valve is not exhibited.

The third invention has been made in view of the above circumstances and it is the third task to be solved to provide a flush toilet in which the intention of the control person can be compatible with the use of the user during the winter season.

With respect to the flush toilet of the third invention, in a flush toilet having a toilet body and a toilet washing device which is able to wash the toilet body with water, and which has an open/close valve that is able to spout the water by being opened and closed, the improvement is characterized in that the toilet washing device has an electric driving means for driving the open/close valve electrically, a manual handle which is able to release the open/close valve manually, a detection means for detecting the condition of the open/close valve and a control means for controlling the electric driving means based on a detection signal of the detection means in the desired mode, and that the control means makes the open/close valve restore to the initial condition in which the open/close valve is released by the manual handle after carrying out the desired mode in the initial condition.

In the flush toilet of the third invention, it is possible that the electric driving means of the toilet washing device drives the open/close valve electrically, and that the manual handle of the toilet washing device drives the open/close valve manually. During this, the detection means of the toilet washing device detects the condition of the open/close valve, and the control means of the toilet washing device controls the electric driving means based on the detection signal of the detection means in the desired mode.

Accordingly, in the flush toilet of the third invention, when the control person makes the open/close valve in the semi-closed condition by operating the manual handle in order to prevent the freezing during the winter season, and at the same time, he closes the stop cock under the ground, and when the user opens the stop cock to operate the washing switch under such a condition, the control means makes the open/close valve restore to the initial condition after carrying out the mode in the initial condition in which the open/close valve is released by the manual handle. Accordingly, only if the stop cock is closed after the use of the user, it is maintained that the reserved water in the open/close valve is discharged to the western-style toilet body, namely, that water is drained away. As a result, the effect for preventing the freezing of the open/close valve can be exhibited.

Furthermore, if the flush toilet of the third invention may be the one which detects whether or not the user uses the flush toilet by means of an optical detector such as a light sensor and the like, and which is able to wash the toilet automatically, the optical detector detects the control person after he sets the open/close valve at the position for draining water away by means of the manual handle, and the automatic washing operation is started. However, after carrying out the automatic washing operation, the open/close valve is not closed to be the condition in which water is drained away, so this is effective.

In the flush toilet of the third invention, if a stepping motor is adopted as an electric driving means, as the detection means, it is possible to adopt a count means for counting the frequency of pulse of the stepping motor, and a position sensor for detecting a rotation angle of the stepping motor. With such a constitution, by using a pulse signal and a position signal, it is possible to control the stepping motor in the desired mode easily.

BEST MODE FOR CARRYING OUT THE INVENTION

{First Invention}

Embodiments 1 and 2 which embody the first invention are explained hereinafter in conjunction with drawings 1 to 6.

EMBODIMENT 1

Figure 1:
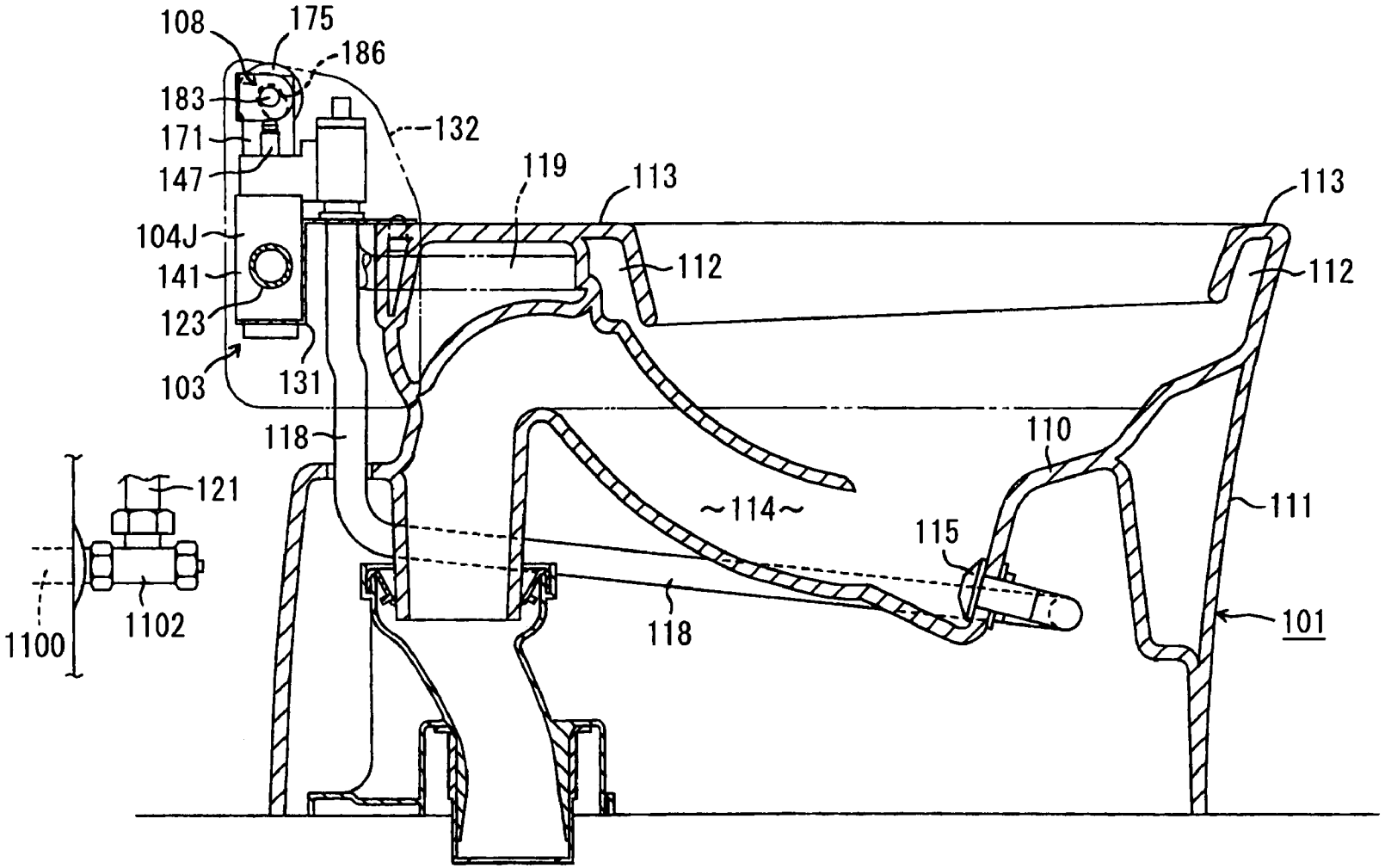
FIG. 1 is a cross-sectional view of an essential portion of a tankless western-style flush toilet according to an embodiment 1 in the first invention.
Figure 2:
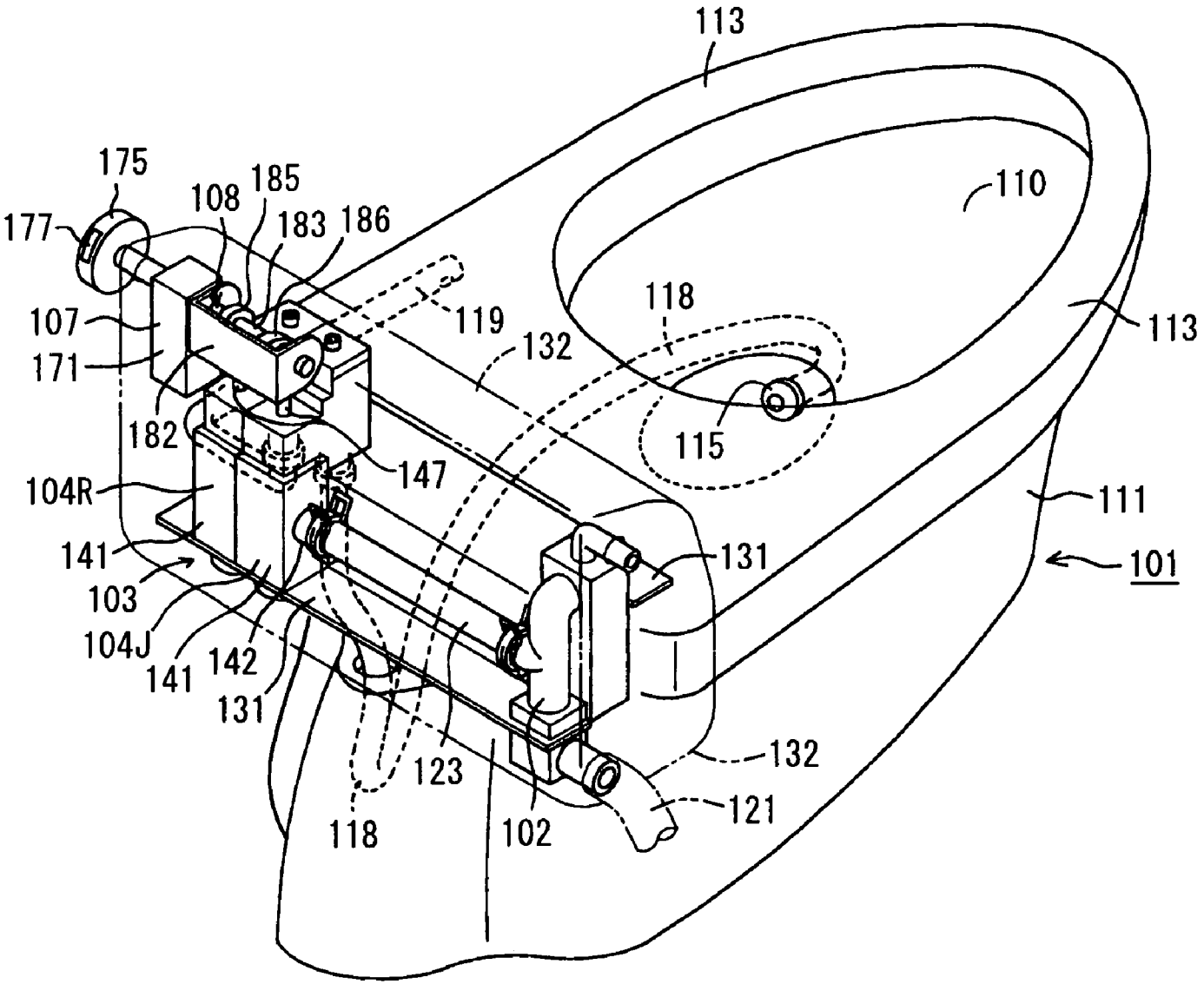
FIG. 2 is a perspective view of an essential portion of a tankless western-style flush toilet according to an embodiment 1 in the first invention.

The embodiment 1 is explained in conjunction with drawings 1 to 6. As shown in FIGS. 1 and 2, a tankless western-style flush toilet in the embodiment 1 has no toilet washing tank.

A western-style toilet body 101 includes a toilet bowl 111 having a bowl portion 110 which receives filth, a rim 113 having a rim channel 112 which encircles at an upper periphery of the bowl portion 110 and a trap portion 114 which is communicated with the bottom of the bowl portion 110 and which flows the filth out. At an inlet of the trap portion 114, a jet nozzle 115 is mounted.

In the western-style toilet body 101, a jet conduit 118 for supplying water to the jet nozzle 115 and a rim conduit 119 for supplying water to the rim channel 112 are mounted. A water supply pipe 1100 such as a city water service pipe and the like is arranged in a toilet wall, and a stop cock 1102 is attached to the water supply pipe 1100. A toilet lid and a toilet seat are not shown in FIGS. 1 and 2.

As shown in FIG. 2, a branch device 102 for dividing water into water for washing a toilet and water for other use is mounted at one side of a rear portion in the width direction of the western-style toilet body 101. The branch device 102 is connected to the stop cock 1102 by way of a flexible hose 121. The branch device 102 is communicated with a toilet washing device 103 by way of a water supply conduit 123, and water which is supplied from the stop cock 1102 and which is divided by the branch device 102 is supplied to the toilet washing device 103 by way of the water supply conduit 123.

The toilet washing device 103 is assembled to a base plate 131 which is held at the rear portion of the western-style toilet body 101, and the toilet washing device 103 is concealed by a cover 132. The toilet washing device 103 includes a rim open/close valve 104R for supplying water to the rim channel 112, a jet open/close valve 104J for supplying water to the jet nozzle 115 and a cam device 108 for opening and closing the open/close valves 104R and 104J. Two open/close valves 104R and 104J are positioned in such a manner that they are adjacent to each other.

Figure 3:
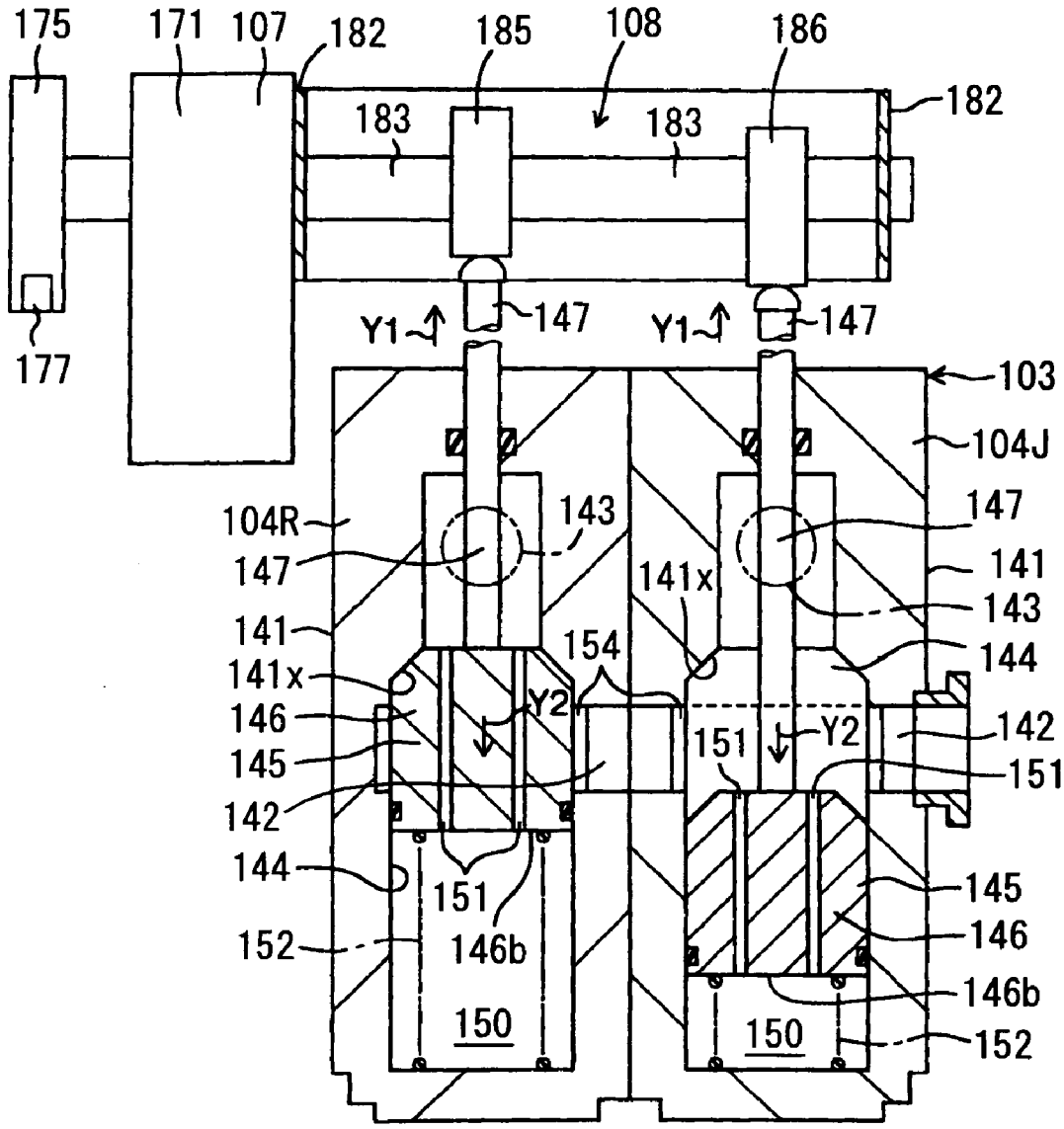
FIG. 3 is a cross-sectional view of a rim open/close valve and a jet open/close valve which includes a cam device according to an embodiment 1 in the first invention.

An inner constitution of the jet open/close valve 104J is shown in FIG. 3. The jet open/close valve 104J has a valve housing 141 which has a water-in port 142 for taking water in and a water-out port 143 for spouting water out, and a valve mechanism 145 which is mounted on the valve housing 141. In the inside of the valve housing 141, a piston room 144 which is communicated with the water-in port 142 and the water-out port 143 is formed. The valve mechanism 145 of the open/close valve 104J is constituted by a piston 146 which is slidably mounted on the piston room 144, and a shaft 147 which is coaxially fixed to one end surface (an upper end surface) of the piston 146 in such a manner that the shaft 147 is protruded upward from an upper end of the valve housing 141. In the piston room 144, a pressure offset room 150 is formed. The pressure offset room 150 is communicated with the side of the water-out port 143 by way of plural communication holes 151 as passages which are formed in the piston 146. In the pressure offset room 150, a spring 152 as a force act means is arranged. The spring 152 is disposed between the valve housing 141 and the other end surface 146*b* of the piston 146. The spring 152 always pushes the piston 146 toward the direction of an arrow Y1, namely, upward to close the communication between the water-in port 142 and the water-out port 143. Atop end portion of the shaft 147 is protruded upward from the valve housing 141, and it can be pushed downward by the cam device 108.

An inner constitution of the rim open/close valve 104R is substantially the same as the inner constitution of the jet open/close valve 104J, so an explanation thereof is omitted. The water-in port 142 of the jet open/close valve 104J and the water-in port 142 of the rim open/close valve 104R are communicated with each other by way of a ring-shaped intermediate communication passage 154 which is formed in the valve housing 141.

The cam device 108 is held at a bracket 182 which is arranged upward from the open/close valves 104R and 104J. The cam device 108 includes a rotation axis 183 as a rotation body which is rotatably held at the bracket 182 in the horizontal condition, a first cam 185 and a second cam 186 which are mounted on the rotation axis 183 in such a manner that they are protruded in the axially right-angled direction. When the rotation axis 183 is rotated, the first cam 185 and the second cam 186 are rotated. Then, a cam surface at an outer periphery of the first cam 185 is brought into contact with the shaft 147 of the rim open/close valve 104R to move the shaft 147 downward. At the same time, a cam surface at an outer periphery of the second cam 186 is brought into contact with the shaft 147 of the jet open/close valve 104J to move the shaft 147 downward.

A driving device 107 is fixed to the bracket 182, and an electric motor 171 and a reduction gear which is not shown in the drawing and which transmits rotation force of the electric motor 171 to the rotation axis 183 are contained in the driving device 107. The driving device 107 is to open the open/close valves 104R and 104J by fluctuating a manual handle 175 or by operating the cam device 108.

At an axial end of the rotation axis 183, the manual handle 175 which is rotated by a manual operation of the user is mounted. The manual handle 175 is to open and close the open/close valves 104R and 104J by operating the cam device 108 manually at the time of an emergency such as power failure and the like.

On the manual handle 175, a handle sensor 177 which is functioned as a detection means is mounted. The handle sensor 177 is to detect that the user touches the manual handle 175 or that a very small angle deviation is generated on the manual handle 175. The handle sensor 177 is constituted by a pressure sensitive touch sensor.

Figure 4:
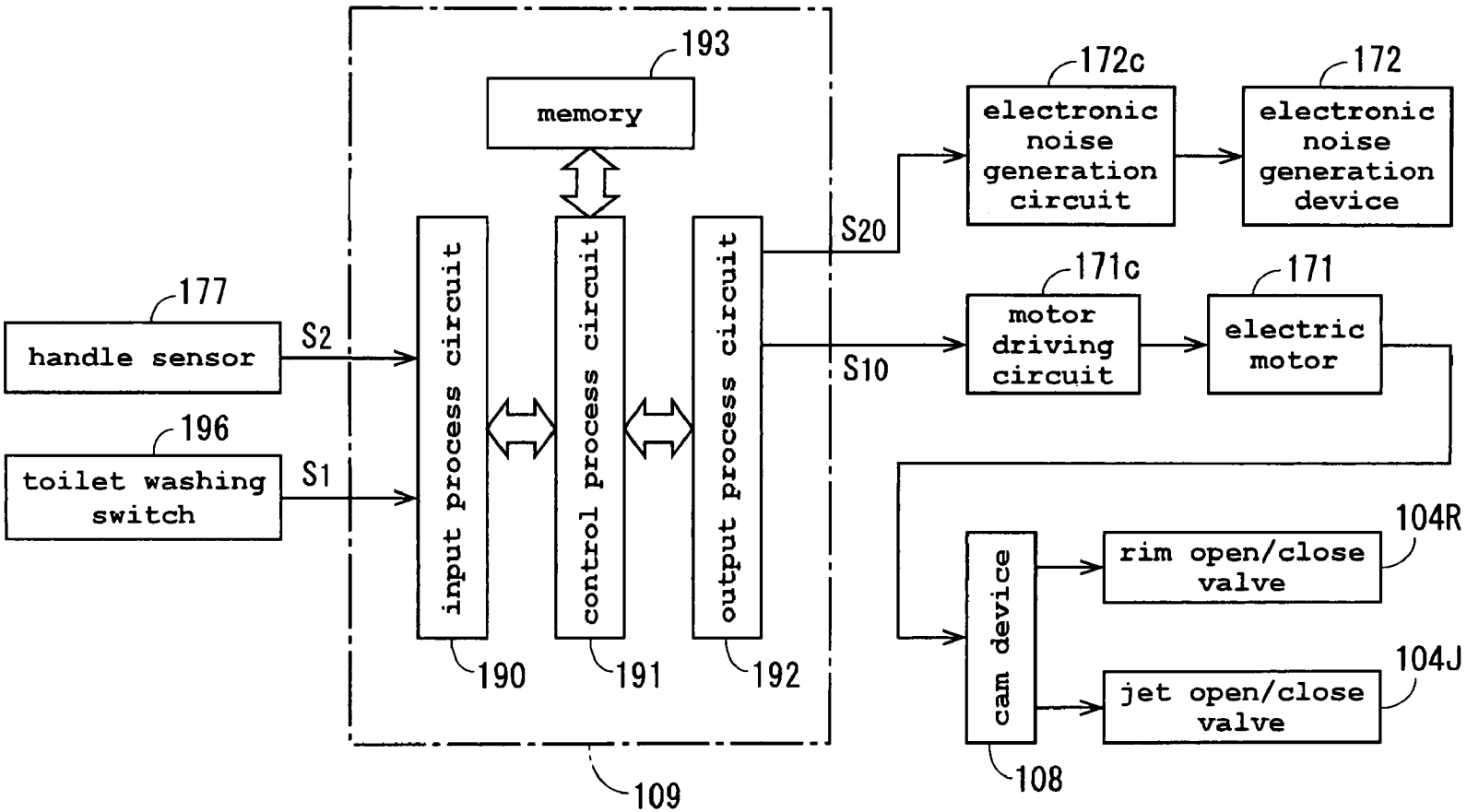
FIG. 4 is a block view of a control system which includes a controller according to an embodiment 1 in the first invention.

At a housing which is integral with the cover 132 shown in FIGS. 1 and 2, a toilet washing switch 196 which is shown in FIG. 4 is mounted. The toilet washing switch 196 is subjected to a push operation by the user who sits on the toilet seat, and the electric motor 171 is driven to carry out the washing of the toilet bowl 111 of the western-style toilet body 101 as a normal mode.

A controller 109 has an input process circuit 190 for processing an input signal, a control process circuit 191 in which a CPU for outputting a signal based on a signal from the input process circuit 190 is contained, an output process circuit 192 for outputting a control signal based on a signal of the control process circuit 191 and a memory 193 for storing program and data. In the input process circuit 190 of the controller 109, a washing start signal S1 from the toilet washing switch 196 and a touch signal S2 from the handle sensor 177 are inputted. When the user carries out a push operation of the toilet washing switch 196, the washing start signal S1 is inputted from the toilet washing switch 196 to the controller 109. Based on the washing start signal S1, a motor control signal S10 is inputted from the output process circuit 192 of the controller 109 to a motor driving circuit 171*c*, and the electric motor 171 is controlled.

When the finger of the user touches the manual handle 175, the touch signal S2 is inputted from the handle sensor 177 to the controller 109. Based on the touch signal S2, the motor control signal S10 and an intermittent noise generation signal S20 are generated from the output process circuit 192 of the controller 109. The motor control signal S10 is inputted to the motor driving circuit 171*c* to control the electric motor 171. The intermittent noise generation signal S20 is inputted to an electronic noise generation circuit 172*c* to operate an electronic noise generation device 172, and an intermittent electronic noise is generated.

In the western-style toilet body 101 of the tankless western-style flush toilet which is constituted as above, water is supplied to the toilet washing device 103 by way of the water supply pipe 1100, the stop cock 1102, the flexible hose 121, the branch device 102 and the water supply conduit 123. In the toilet washing device 103, as far as the user doesn't carry out an operation of the toilet washing switch 196 in order to wash the toilet bowl 111, both of the open/close valves 104J and 104R are closed. Namely, if being explained by FIG. 3, the piston 146 is moved to one side in the axial direction, in other words, the direction of an arrow Y1, by act force of the spring 152. Then, the piston 146 is attached to a seat face 141*x* of the valve housing 141, and an outer periphery of the piston 146 closes the water-in port 142. Accordingly, the communication between the water-in port 142 and the water-out port 143 is closed, and water is not supplied to the bowl portion 111 of the western-style toilet body 101.

The following explanation is about the case that the toilet bowl 111 is washed by the normal mode. In this case, in accordance with the operation of the toilet washing switch 196 of the user, the motor control signal S10 is inputted by the controller 109 to the motor driving circuit 171*c* to drive the electric motor 171 of the driving device 107, and the rotation axis 183 is rotatingly driven. Due to this, a cam surface of the first cam 185 pushes the shaft 147 of the rim open/close valve 104R downward to open the rim open/close valve 104R, and "rim water supply" is carried out. If being explained by FIG. 3, the spring 152 is elastically contracted, and the piston 146 is moved to the other direction of the axial direction, namely, toward the direction of an arrow Y2. Accordingly, the piston 146 is detached from the seat face 141*x* of the valve housing 141 to open the communication between the water-in port 142 and the water-out port 143. When the rim open/close valve 104R is opened like this, water is supplied to the rim channel 112 by way of the rim conduit 119, and an inner wall surface of the bowl portion 110 of the toilet bowl 111 is washed.

In accordance with the driving of the cam device 108, the cam surface of the first cam 185 doesn't come to push the shaft 147 of the rim open/close valve 104R downward, and the rim open/close valve 104R is closed. After that, the cam surface of the second cam 186 pushes the shaft 147 of the jet open/close valve 104J downward to open the jet open/close valve 104J, and "jet water supply" is carried out. When the jet open/close valve 104J is opened like this, water is supplied to the jet nozzle 115 by way of the jet conduit 118, and a siphon effect is forcibly generated in the trap portion 114.

Next, in accordance with the driving of the cam device 108, the cam surface of the second cam 186 doesn't come to push the shaft 147 of the jet open/close valve 104J downward, and the jet open/close valve 104J is closed. After that, the cam surface of the first cam 185 again pushes the shaft 147 of the rim open/close valve 104R downward to open the rim open/close valve 104R, and "rim water supply" is carried out. Due to this, water is supplied to the rim channel 112 by way of the rim conduit 119 to seal the bowl portion 110 of the toilet bowl 111 with water.

As shown in FIG. 2, when the electric motor 171 of the driving device 107 is not operated by power failure or breakdown of the electric motor 171 and the like, the user operates the manual handle 175 which is exposed from the cover 132. Namely, when the user fluctuates the manual handle 175 manually, the rotation axis 183 of the cam device 108 is rotated manually, and the first cam 185 and the second cam 186 are rotated. Due to this, in the same manner as that of the case in which the electric motor 171 is driven, the rim open/close valve 104R is opened to carry out "rim water supply", and water is supplied to the rim channel 112 by way of the rim conduit 119, and an inner wall surface of the bowl portion 110 of the toilet bowl 111 is washed. Furthermore, in accordance with a manual operation, the cam surface of the second cam 186 pushes the shaft 147 of the jet open/close valve 104J down ward to open the jet open/close valve 104J, and "jet water supply" is carried out. Then, water is supplied to the jet nozzle 115 by way of the jet conduit 118 to generate a siphon effect in the trap portion 114 forcibly. Next, the rim open/close valve 104R is again opened to carry out "rim water supply", and the bowl portion 110 of the toilet bowl 111 can be sealed with water.

Since the manual handle 175 is mounted in such a manner that the manual handle 175 is exposed from the cover 132 like this, although it is not in case of emergency, there is the possibility that the user who is not accustomed to a tankless western-style flush toilet mistakenly operates the manual handle 175 for emergency after he relieves oneself. In this respect, in the tankless western-style flush toilet according to the embodiment 101, even if the user is not accustomed to such a tankless western-style flush toilet and he doesn't notice the existence of the toilet washing switch 195, when the user operates the manual handle 175 lightly, the handle sensor 177 detects that the user touches the manual handle 175 lightly. Due to this, the controller 109 drives the electric motor 171 by way of the motor driving circuit 171*c* to fluctuate the manual handle 175, and the washing of the toilet bowl 111 of the western-style toilet body 101 is carried out. Furthermore, the controller 109 operates the electronic noise generation device 172 by way of the electronic noise generation circuit 172*c* to generate an intermittent electronic noise.

In other words, as shown in FIG. 4, the controller 109 inputs the motor control signal S10 to the motor driving circuit 171*c* to drive the electric motor 171, and the rotation axis 183 is rotatingly driven. Besides, the controller 109 inputs the intermittent noise generation signal S20 to the electronic noise generation circuit 172*c* to operate the electronic noise generation device 171, and an intermittent electronic noise is generated. Namely, when the user touches the manual handle 175 lightly with his finger, an operation of the cam device 108 is assisted by the electric motor 171, and at the same time, an intermittent electronic noise is generated.

As a result, in the same manner as the above, the first cam 185 pushes the shaft 147 of the rim open/close valve 104R downward to open the rim open/close valve 104R, and "rim water supply" is carried out. Next, the cam surface of the first cam 185 doesn't come to push the shaft 147 of the rim open/close valve 104R downward, and the rim open/close valve 104R is closed. After that, the cam surface of the second cam 186 pushes the shaft 147 of the jet open/close valve 104J downward to open the jet open/close valve 104J, and the above-mentioned "jet water supply" is carried out. Next, the cam surface of the second cam 186 doesn't come to push the shaft 147 of the jet open/close valve 104J downward, and the jet open/close valve 104J is closed. After that, the cam surface of the first cam 185 again pushes the shaft 147 of the rim open/close valve 104R downward to open the rim open/close valve 104R, and "rim water supply" is carried out.

Figure 5:
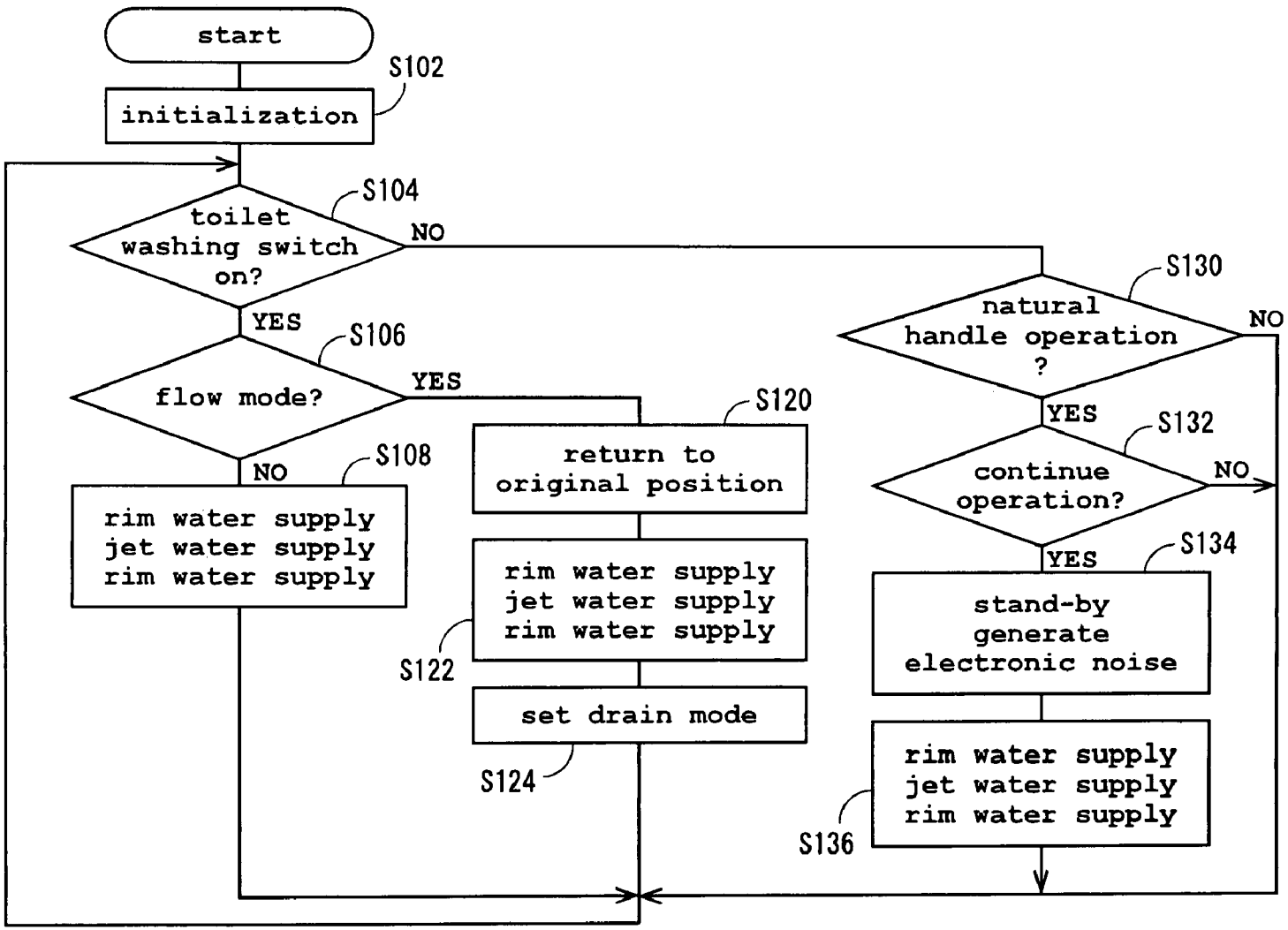
FIG. 5 is a flow chart which is carried out by a CPU of a controller according to an embodiment 1 in the first invention.

At this time, the CPU which is contained in the controller 109 executes a control flow chart which is shown in FIG. 5. Namely, at the step S102, an initialization is carried out. At the step S104, the judgment is made whether or not an ON operation of the toilet washing switch 196 is carried out. If the user carries out an ON operation of the toilet washing switch 196, he has an intention of washing the toilet bowl 111 of the western-style toilet body 101 by the normal washing mode. Next, at the step S106, the judgment is made whether or not the rotation axis 183 of the cam device 108 is at an original position, namely, whether or not a drain mode is set. If the drain mode is not set, the control flow chart proceeds to the step S108, and the electric motor 171 is driven to rotate the rotation axis 183 of the cam device 108, the first cam 185 and the second cam 186. Accordingly, as afore mentioned, water supply is carried out in the order of "rim water supply" →"jet water supply"→"rim water supply", and the bowl portion 110 of the toilet bowl 111 of the western-style toilet body 101 is washed. After that, the control flow chart returns to the step S104.

The drain mode is applied to the case that the freezing of water is prevented during the cold season. So, in the drain mode, by opening the open/close valves 104R and 104J slightly on condition that the stop cock 1102 is closed, water which may be remained in the open/close valves 104R and 104J and the like is discharged. It is possible to adopt a flow mode, in which a small amount of water per unit time continuously flows into the western-style toilet body 101 by always opening the open/close valves 104R and 104J slightly, as a drain mode.

As the result of the judgment at the step S106, if the drain mode is set, the control flow chart proceeds from the step S106 to the step S120, and the electric motor 171 is driven slightly to return the rotation axis 183 to its original position. At this time, a return amount is stored in the memory 193. After that, at the step S122, the electric motor 171 is further driven to rotate the rotation axis 183, the first cam 185 and the second cam 186. Accordingly, in the same manner as afore mentioned, water supply is carried out in the order of "rim water supply"→"jet water supply"→"rim water supply", and the toilet bowl 111 of the western-style toilet body 101 is washed. After that, the control flow chart proceeds to the step S124, and the electric motor 171 is rotated backward in the stored return amount. Then, the mode is returned to the drain mode to open the open/close valves 104R and 104J slightly, and the control flow chart returns to the step S104.

As the result of the judgment at the step S104, if the toilet washing switch 196 is OFF, it is not requested that the toilet bowl 111 of the western-style toilet body 101 is washed by the normal washing mode. So, the control flow chart proceeds from the step S104 to the step S130, and the judgment is made whether or not a touch operation of the manual handle 175 is carried out by the user. This judgment is carried out based on a touch signal from the handle sensor 177 of the manual handle 175. When the touch operation of the manual handle 175 is not carried out by the user, the control flow chart returns from the step S130 to the step S104.

When the touch operation of the manual handle 175 is carried out by the user, the control flow chart proceeds to the step S132, and the judgment is made whether or not the touch operation of the manual handle 175 is continued for the predetermined time ΔT1 since the time at the step S130 (for example, in the range of from 0.02 to 1 second). The operation of the manual handle 175 is continued, the judgment accuracy that the user actually carries out the touch operation of the manual handle 175 is improved. So, the step S132 is functioned as a confirmation means for confirming whether or not the touch operation of the manual handle 175 is existed. Accordingly, if the touch operation of the manual handle 175 by the user is continued, the control flow chart proceeds to the step S134. Then, an electronic noise is generated, and at the same time, the predetermined time ΔT2 is acquired for stand-by. After that, the control flow chart proceeds to the step S136, and the electric motor 171 is driven to rotate the first cam 185 and the second cam 186. Due to this, in the same manner as aforementioned, water supply is carried out in the order of "rim water supply"→"jet water supply"→"rim water supply", and the bowl portion 110 of the toilet bow 111 of the western-style toilet body 101 is washed.

Thus, in this tankless western-style flush toilet, the manual handle 175 is assisted to be fluctuated, and the washing of the western-style toilet body 101 is carried out. Therefore, in the tankless western-style flush toilet, the user who is not accustomed to a tankless western-style flush toilet can wash the western-style toilet body 101 with an excellent operability. Furthermore, by the generation of the electric noise, it is known that the manual handle 175 is assisted. So, the user doesn't try to rotate the manual handle 175 unnecessarily, and it is possible to prevent malfunction or breakdown.

EMBODIMENT 2

Figure 6:
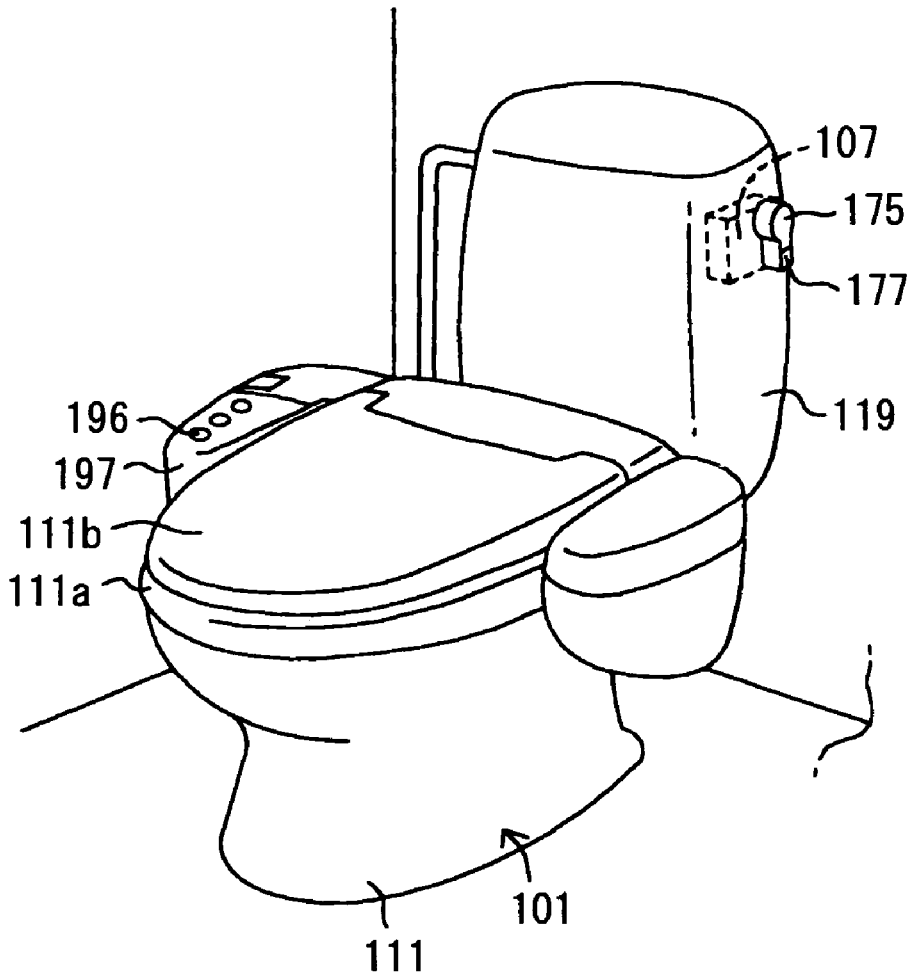
FIG. 6 is a perspective view of a western-style flush toilet which has a toilet washing tank according to an embodiment 2 in the first invention.

FIG. 6 shows the embodiment 2. The embodiment 2 is a tank-type flush toilet having a toilet washing tank. The portions which exhibit the common function as that of the embodiment 1 are labeled as the common symbols.

A western-style toilet body 101 includes a toilet bowl 111 having a bowl portion 110, a toilet seat 111*a* and a toilet lid 111*c* which are supported at an upper portion of the toilet bowl 111 in such a manner that they can be fluctuated and a toilet washing tank 119 which is mounted at a rear portion of the toilet bowl 111. In the toilet washing tank 119, a valve mechanism for supplying water which is stored in the toilet washing tank 119 to the western-style toilet body 101 at the time of opening the valve is equipped.

At the side surface of the toilet washing tank 119, a manual handle 175 which is mechanically connected to the valve mechanism of the toilet washing tank 119 is mounted in such a manner that the manual handle 175 can be fluctuated. When the manual handle 175 is fluctuated, the valve mechanism of the toilet washing tank 119 is opened, and water which is stored in the toilet washing tank 119 is supplied to the bowl portion 110 of the western-style toilet body 101.

To the manual handle 175, a driving device 107 by which the manual handle 175 is fluctuated is connected. The driving device 107 is held at the toilet washing tank 119, and it is constituted by an electric motor and a reduction gear for reducing the rotation speed of the electric motor.

On the manual handle 175, a handle sensor 177 as a detection means for detecting whether or not the user touches the manual handle 175 is mounted. A controller for controlling the electric motor of the driving device 107 is contained in a control panel 197 having a toilet washing switch 196.

Also in the embodiment 2, when the user touches the manual handle 175 lightly, the handle sensor 177 detects such a condition. Then, the controller drives the electric motor of the driving device 107, and at the same time, an intermittent electronic noise is generated. Accordingly, the manual handle 175 is automatically fluctuated in the direction for opening the valve, and the washing of the bowl portion 110 of the toilet bowl 111 of the western-style toilet body 101 is carried out.

Therefore, in the tank-type western-style flush toilet of the embodiment 2, it is possible to obtain an advantage that the fluctuation operation of the manual handle 175 assisted by the electric motor to be simplified. So, not only a serious patient or an old man whose physical strength is considerably weak but also an ordinary person obtains a good operability. Furthermore, by the generation of the intermittent electric noise, the user knows that the manual handle 175 assisted to be fluctuated by the electric motor. So, the user doesn't try to rotate the manual handle 175 necessarily, and it is possible to prevent malfunction or breakdown.

{Second Invention}

An embodiment which embodies the second invention is explained hereinafter in conjunction with drawings 7 to 11.

Figure 7:
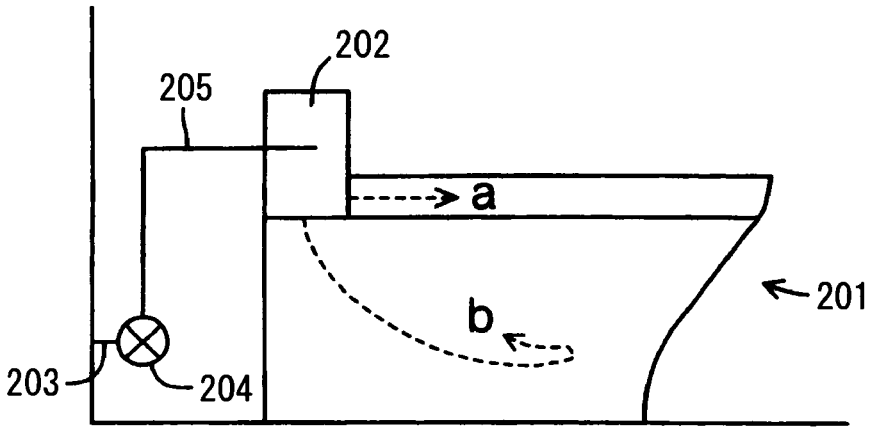
FIG. 7 is a typical view of a tankless western-style flush toilet according to an embodiment in the second invention.

FIG. 7 is a typical view of a tankless western-style flush toilet according to the embodiment. The tankless western-style flush toilet has no toilet washing tank, and it includes a western-style toilet body 201, a toilet washing device 202, a heating toilet seat which is not shown in the drawing and a toilet lid which is not shown in the drawing.

The western-style toilet body 201 is made of porcelain. The toilet washing device 202 is directly connected to a city water service pipe 203 by a flexible hose 205 via a stop cock 204, and it is possible to wash the western-style toilet body 201 by spouting water a and water b.

Figure 8:
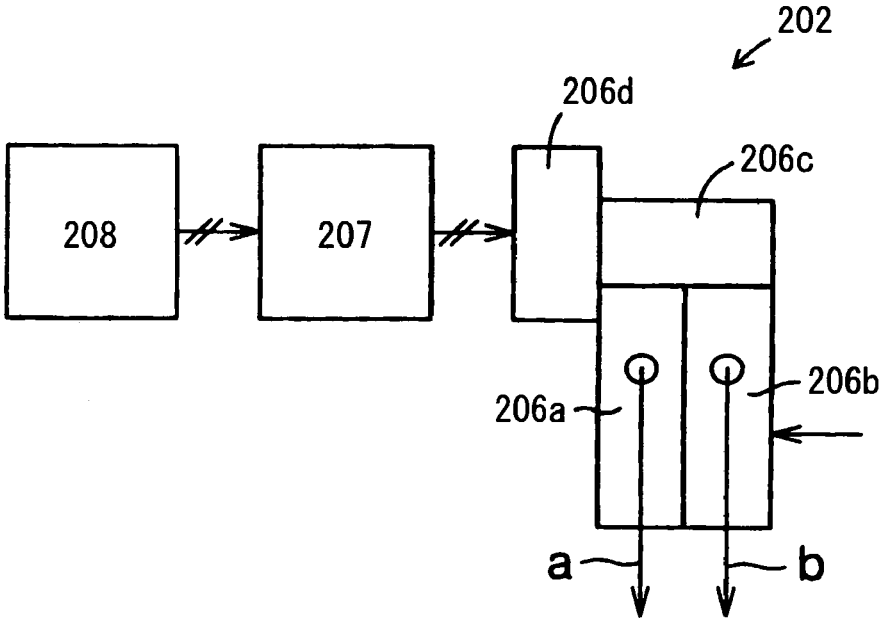
FIG. 8 is a typical view of a toilet washing device and the like according to a tankless western-style flush toilet of an embodiment in the second invention.

As shown in FIG. 8, in the inside of the toilet washing device 202, a rim open/close valve 206*a* and a jet open/close valve 206*b* are equipped. A cam device 206*c* is mounted upward from the rim open/close valve 206*a* and the jet open/close valve 206*b*, and a stepping motor 206*d* is mounted at the side of the cam device 206*c*. The cam device 206*c* is driven by the stepping motor 206*d*, and the rim open/close valve 206*a* and the jet open/close valve 206*b* are opened and closed by driving the cam device 206*c*.

Figure 9:
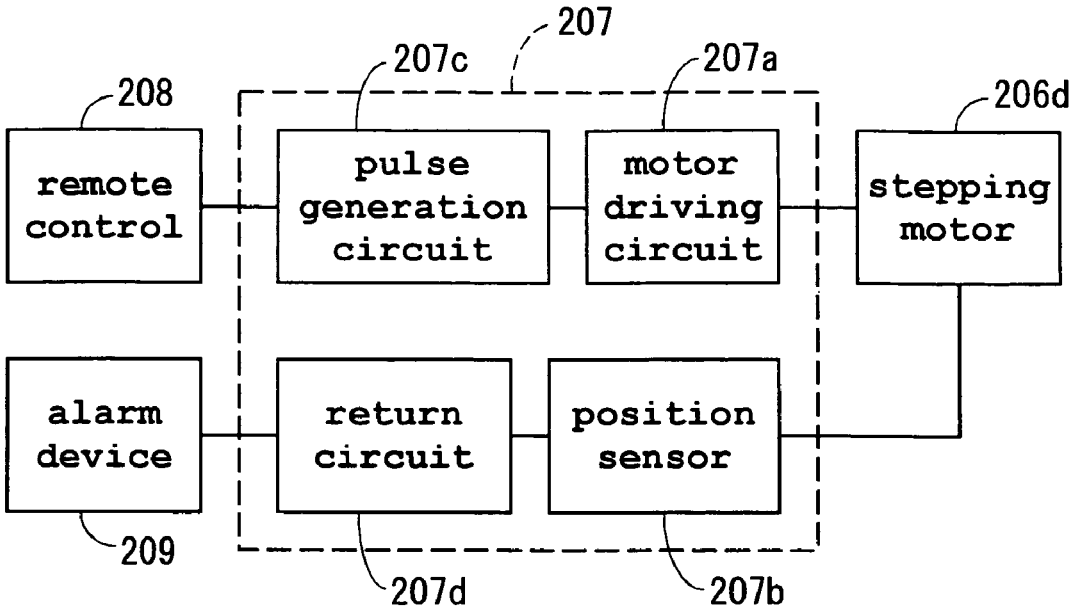
FIG. 9 is a block constitutional view of a controller and the like according to a tankless western-style flush toilet of an embodiment in the second invention.

The stepping motor 206*d* is electrically connected to a controller 207, and the controller 207 can be operated by a remote control 208. As shown in FIG. 9, the controller 207 has a motor driving circuit 207*a* and a position sensor 207*b* which are connected to the stepping motor 206*d*, a pulse generation circuit 207*c* which is connected to the motor driving circuit 207*a* and which generates a pulse signal and a return circuit 207*d* by which the abnormal condition of the rim open/close valve 6*a* and the jet open/close valve 206*b* is returned to the normal condition. Here, the position sensor 207*b* detects the open or closed condition of the rim open/close valve 206*a* and the jet open/close valve 206*b* based on the pulse signal which is transmitted to the stepping motor 206*d*. The return circuit 207*d* is connected to an alarm device 209 as a notice means which is mounted in the tankless western-style flush toilet.

Figure 10:
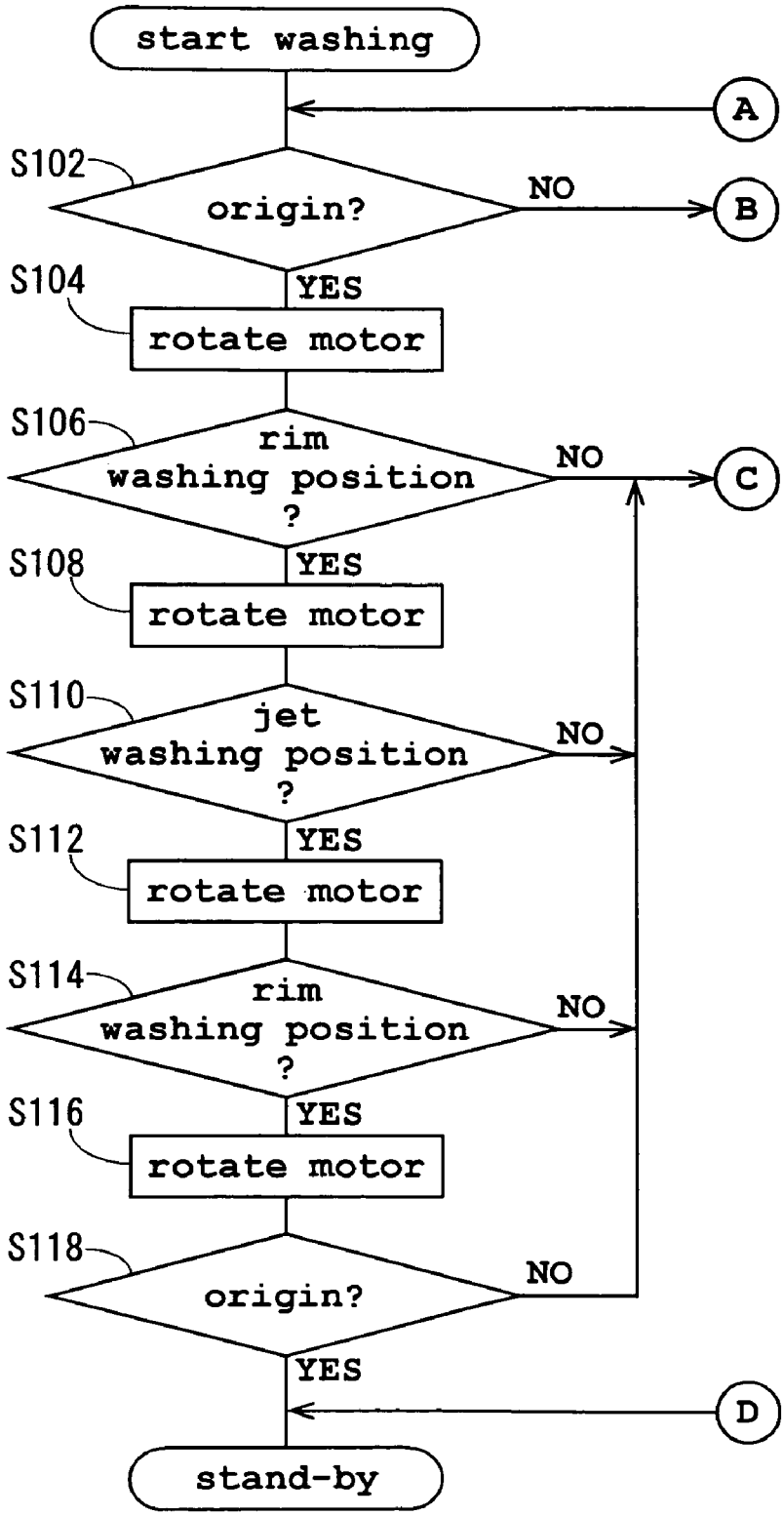
FIG. 10 is a flow chart for the normal washing treatment which is carried out by a controller according to a tankless western-style flush toilet of an embodiment in the second invention.
Figure 11:
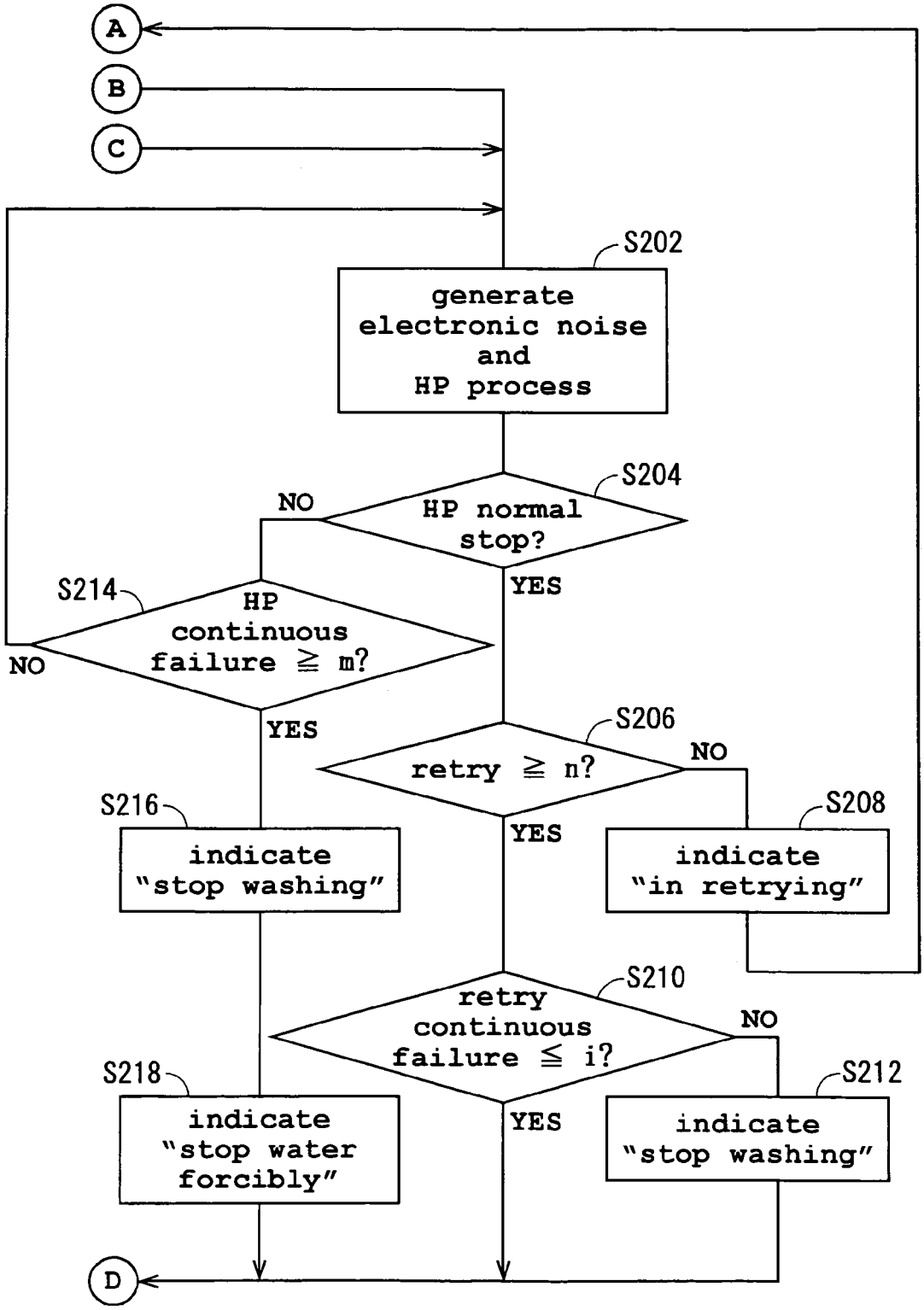
FIG. 11 is a flow chart for an abnormal treatment which is carried out by a controller according to a tankless western-style flush toilet of an embodiment in the second invention.

In the tankless western-style flush toilet which is constituted as above, the controller 207 carries out a washing treatment in accordance with a flow chart shown in FIGS. 10 and 11 by the return circuit 207*d* and a memory means which is not shown in the drawing.

When the user pushes a washing start button of the remote control 208, first, a normal washing treatment is carried out in accordance with the flow chart which is shown in FIG. 10. Namely, at the step S102, the judgment is made whether or not both of the rim open/close valve 206*a* and the jet open/close valve 206*b* are in the closed condition. At this time, under the necessity of determining the standard of the frequency of pulse which is transmitted to the stepping motor 206*d*, when both of the rim open/close valve 206*a* and the jet open/close valve 206*b* are in the closed condition, this is determined as "the origin".

When the judgment of the step S102 is "the origin", the flow chart proceeds to the step S104. Due to this, the stepping motor 206*d* is rotated in the predetermined angle to be stopped, and the rim open/close valve 206*a* is released.

Accordingly, water a is spouted for the predetermined time, and filth is collected in a trap.

Next, the flow chart proceeds to the step S106, and the judgment is made whether or not the rim open/close valve 206*a* is in the open condition, and whether or not the jet open/close valve 206*b* is in the closed condition. Here, when the judgment is YES, the flow chart proceeds to the step S108. Due to this, the stepping motor 206*d* is rotated in the predetermined angle to be stopped, and the rim open/close valve 206*a* is closed, and at the same time, the jet open/close valve 206*b* is released. Accordingly, water a is stopped, and water b is spouted for the predetermined time to generate a siphon effect forcibly, and the filth is discharged.

Then, the flow chart proceeds to the step S110, and the judgment is made whether or not the rim open/close valve 206*a* is in the closed condition, and whether or not the jet open/close valve 206*b* is in the open condition. Here, when the judgment is YES, the flow chart proceeds to the step S112. Due to this, the stepping motor 206*d* is rotated in the predetermined angle to be stopped, and the jet open/close valve 206*b* is closed, and at the same time, the rim open/close valve 206*a* is released. Accordingly, water b is stopped, and water a is spouted for the predetermined time to carry out a water sealing treatment in the trap.

Next, the flow chart proceeds to the step S114, and the judgment is made whether or not the rim open/close valve 206*a* is in the open condition, and whether or not the jet open/close valve 206*b* is in the closed condition. Here, when the judgment is YES, the flow chart proceeds to the step S116. Due to this, the stepping motor 206*d* is rotated in the predetermined angle to be stopped, and the flow chart proceeds to the step S118. Accordingly, the judgment is made whether or not both of the rim open/close valve 206*a* and the jet open/close valve 206*b* are in the closed condition. Here, when the judgment is YES, the condition becomes stand-by to finish the washing treatment.

On the other hand, when the judgment is NO at the steps S102, S106, S110, S114 and S118, this means the abnormal condition, and an abnormal treatment is carried out in accordance with a flow chart which is shown in FIG. 11.

Namely, first, at the step S202, an electronic noise for notifying the abnormal condition is generated by an alarm device 209, and at the same time, a return treatment to "the origin" is carried out. After that, the flow chart proceeds to the step S204, and the judgment is made whether or not the return to "the origin" is normally carried out. Here, when the judgment is YES, the flow chart proceeds to the step S206, and the judgment is made how many times retry is repeated. When the frequency of the retry is less than n times, the judgment is NO. Then, at the step S208, the alarm device 209 indicates that the retry is going on. After that, the flow chart returns to the step S102 which is shown in FIG. 10, and a normal washing treatment is carried out. The return circuit 207*d* and the steps S202, S204, S206 and S208 in the memory means are the return means.

On the other hand, at the step S206, if it is judged that the frequency of the retry is not less than n times, the judgment is YES, and the flow chart proceeds to the step S210. Due to this, it is possible to prevent the retry from being repeated endlessly, and to prevent waste consumption of energy.

Then, at the step S210, the judgment is made how many times the frequency of the retry, which is judged to be not less than n times, is. When this frequency is not more than i times, the judgment is YES, and the condition becomes stand-by. Furthermore, when the frequency of the retry, which is judged to be not less than n times, is more than i times, the judgment is NO. Then, the flow chart proceeds to the step S212, and the alarm device 209 indicates the indication of "stop washing", and after that, the condition becomes stand-by. Accordingly, it is possible to inform the user that the tankless western-style flush toilet is out of order.

Besides, at the step S204, when it is judged that the return to "the origin" is not normally carried out, the judgment is NO, and the flow chart proceeds to the step S214. Here, the frequency that the return to "the origin" is not normally carried out is compared. When the frequency is less than m times, the judgment is NO, and the flow chart returns to the step S202. Furthermore, when the frequency is more than m times, the judgment is YES. Then, the flow chart proceeds to the step S216, and the alarm device 209 indicates the indication of "stop washing". After that, the flow chart proceeds to the step S218, and the alarm device 209 indicates the indication of "stop water forcibly", and then, the condition becomes stand-by. Accordingly, it is possible to prevent the return treatment to "the origin" from being repeated endlessly, and to prevent waste consumption of energy.

As above-mentioned, in the tankless western-style flush toilet of this embodiment, even if the rim open/close valve 206*a* or jet open/close valve 206*b* becomes the abnormal condition, such a condition is detected by the position sensor 207*b*, and the rim open/close valve 206*a* and the jet open/close valve 206*b* are automatically returned to the closed condition by the return circuit 207*d* and the like.

Therefore, in this tankless western-style flush toilet, water supply is automatically stopped, and waste consumption of water is not occurred.

In addition, in the return circuit 207*d* and the like, water sealing treatment in the western-style toilet body 201 is carried out. So, even if the rim open/close valve 206*a* or the jet open/close valve 206*b* becomes the abnormal condition, it is possible to prevent a nasty smell from going up through a drain pipe.

Moreover, the return circuit 207*d* and the like make the rim open/close valve 206*a* or the jet open/close valve 206*b* in the closed condition after carrying out the normal washing treatment of the western-style toilet body 201. So, even if the rim open/close valve 206*a* or the jet open/close valve 206*b* is in the abnormal condition, the normal washing treatment of the western-style toilet body 201 is carried out at least one time, and the washing of the western-style toilet body 201 is surely carried out. Accordingly, filth is not remained, and the generation of an unpleasant smell is prevented, and the tankless western-style flush toilet becomes sanitary.

Furthermore, in case of exceeding a constant frequency of retry, there turn circuit 207*d* and the like make the rim open/close valve 206*a* or the jet open/close valve 206*b* to be stopped in the closed condition. So, the retry is not repeated endlessly, and finally, water is not left to flow. Accordingly, waste consumption of energy is prevented, and waste consumption of water is also prevented.

{Third Invention}

An embodiment which embodies the third invention is explained hereinafter in conjunction with drawings 12 to 19.

Figure 12:
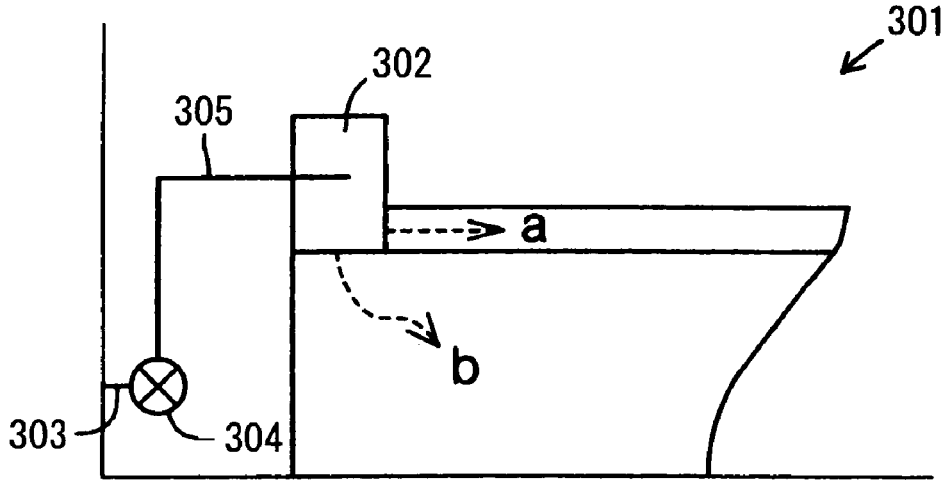
FIG. 12 is a typical view of a tankless western-style flush toilet according to an embodiment in the third invention.

A tankless western-style flush toilet according to this embodiment, as shown in FIG. 12, has no toilet washing tank, and the tankless western-style flush toilet includes a western-style toilet body 301 made of porcelain, a toilet washing device 302, a heating toilet seat which is not shown in the drawing and a toilet lid which is not shown in the drawing.

The toilet washing device 302 is directly connected to a city water service pipe 303 by means of a flexible hose 305 via a stop cock 304, and it is possible to wash the western-style toilet body 301 by spouting water a and water b.

Figure 13:
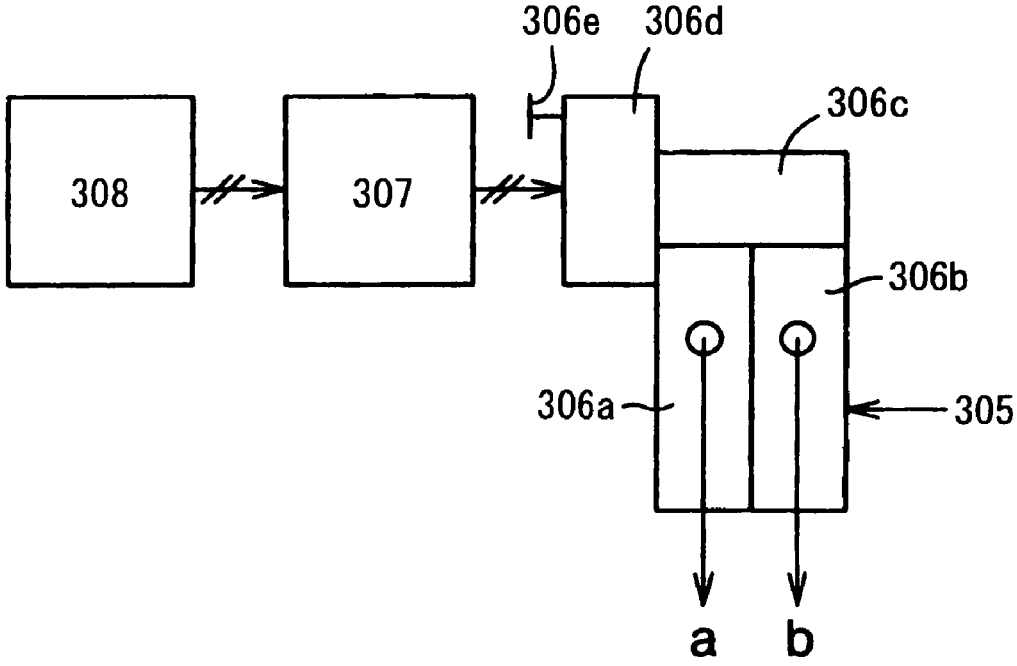
FIG. 13 is a typical view of a toilet washing device and the like according to a tankless western-style flush toilet of an embodiment in the third invention.

As shown in FIG. 13, in the inside of the toilet washing device 302, a rim open/close valve 306*a* and a jet open/close valve 306*b* are equipped. A cam device 306*c* is mounted upward from the rim open/close valve 306*a* and the jet open/close valve 306*b*, and a stepping motor 306*d* as an electric driving means is mounted at the side of the cam device 306*c*. The cam device 306*c* is driven by the stepping motor 306*d*, and the rim open/close valve 306*a* and the jet open/close valve 306*b* are opened and closed by driving the cam device 306*c*. Furthermore, a manual handle 306*e* is attached to the side of the stepping motor 306*d*, and the manual handle 306*e* can release the rim open/close valve 306*a* and the jet open/close valve 306*b* manually.

Figure 14:
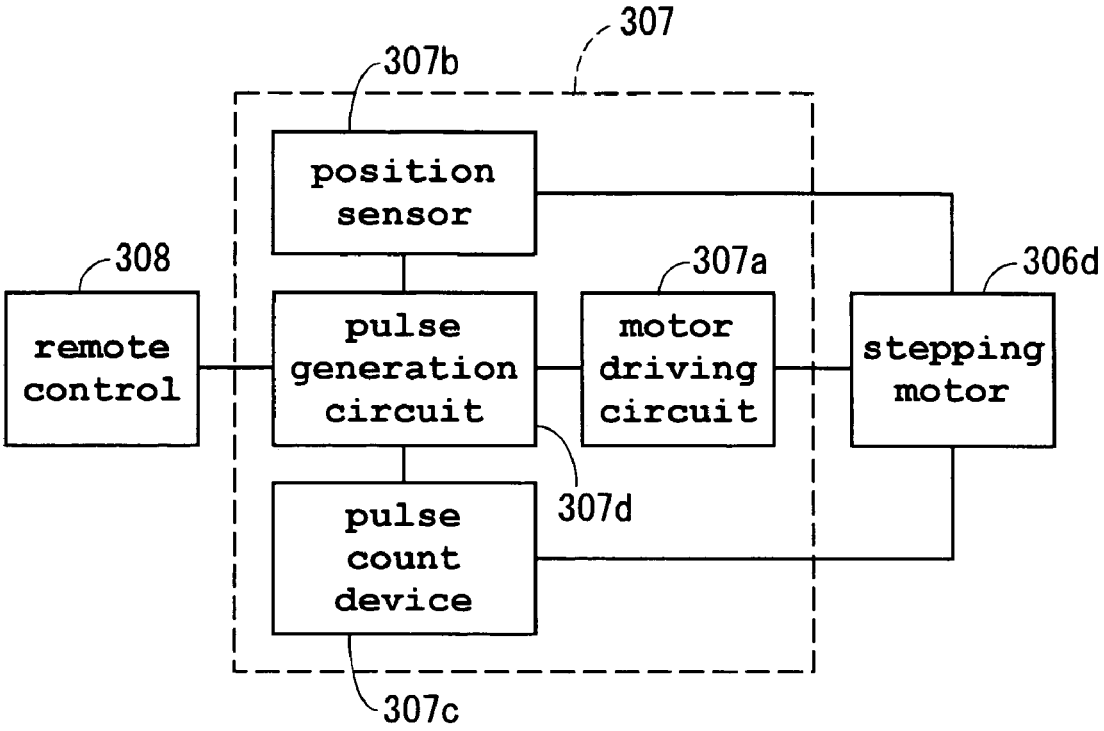
FIG. 14 is a block constitutional view of a controller and the like according to a tankless western-style flush toilet of an embodiment in the third invention.

The stepping motor 306*d* is electrically connected to a controller 307, and the controller 307 can be operated by a remote control 308. As shown in FIG. 14, the controller 307 has a motor driving circuit 307*a* which is connected to the stepping motor 306*d*, a position sensor 307*b* which detects a rotation angle of the stepping motor 306*d* optically to generate a L signal and a H signal, a pulse count device 307*c* as a count means for counting a pulse number of the stepping motor 306*d* and a pulse generation circuit 307*d* which is connected to the motor driving circuit 307*a*, the position sensor 307*b* and the pulse count device 307*c* to generate a pulse signal. The position sensor 307*b* and the pulse count device 307*c* are detection means for detecting the condition of the rim open/close valve 306*a* and the jet open/close valve 306*b*. Besides, the pulse generation circuit 307*d*, a memory device which is not shown in the drawing and a CPU are control means.

As shown in FIGS. 15(B) to 18(B), the rim open/close valve 306*a* has a valve housing 361 and a valve mechanism 362 which is mounted in the valve housing 361.

At the valve housing 361, a water-in port 361*a* which is connected to the flexible hose 305 to take water in, and a water-out port 361*b* which is connected to a rim channel not shown in the drawing of the western-style toilet body 301 to spout water out are formed. Furthermore, in the inside of the valve housing 361, a piston room 361*c* which is communicated with the water-in port 361*a* and the water-out port 361*b* is formed.

The valve mechanism 362 is constituted by a piston 362*a* which is slidably mounted in the piston room 361*c* and which closes the communication between the water-in port 361*a* and the water-out port 361*b* by being attached at one end side, a shaft 362*b* which is coaxially fixed to one end side of the piston 362*a* and which is protruded from the valve housing 361 and a spring 362*c* which is mounted between a lower end of the piston 362*a* and the valve housing 361 to push the piston 362*a* to one end side.

An inner construction of the jet open/close valve 306*b* is the same as that of the rim open/close valve 306*a*. The cam device 306*c* has a rim cam 363 and a jet cam 364, and the rim cam 363 and the jet cam 364 are coaxially fixed to a rotation axis 365. A top end of the shaft 362*b* of the rim open/close valve 306*a* is brought into contact with the rim cam 363 of the cam device 306*c*, and a top end of the shaft 362*b* of the jet open/close valve 306*b* is brought into contact with the jet cam 364. One end of the rotation axis 365 of the cam device 306*c* is connected to the stepping motor 306*d* which is shown in FIGS. 13 and 14 by way of a reduction gear, and the other end of the rotation axis 365 is connected to the manual handle 306*e* as shown in FIGS. 15(A) to 18(A).

Figure 15:
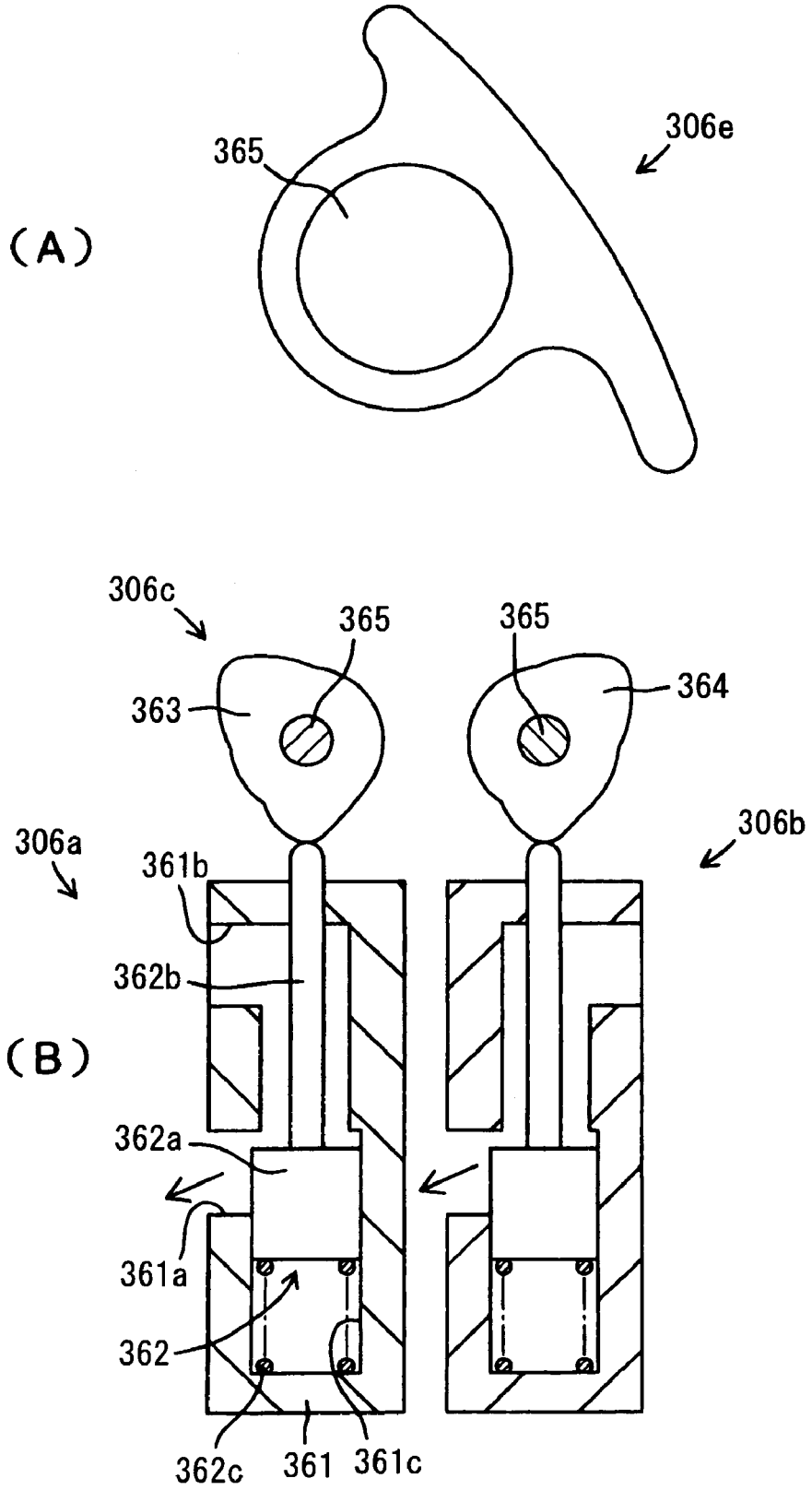
FIG. 15(A) is a side view of a manual handle when it is at "the position where water is drained away" according to a tankless western-style flush toilet of an embodiment in the third invention.
FIG. 15(B) is a cross-sectional view of a rim open/close valve and the jet open/close valve and the like according to a tankless western-style flush toilet of an embodiment in the third invention.

The rim open/close valve 306*a* and the jet open/close valve 306*b* like these are operated as follows. Namely, at "drain position" which is shown in FIG. 15, the manual handle 306*e* is in the condition of FIG. 15(A). Furthermore, as shown in FIG. 15(B) the rim open/close valve 306*a* and the jet open/close valve 306*b* are in the semi-opened condition, so water can be drained away by closing a stop cock which is in the ground and which is not shown in the drawing.

Figure 16:
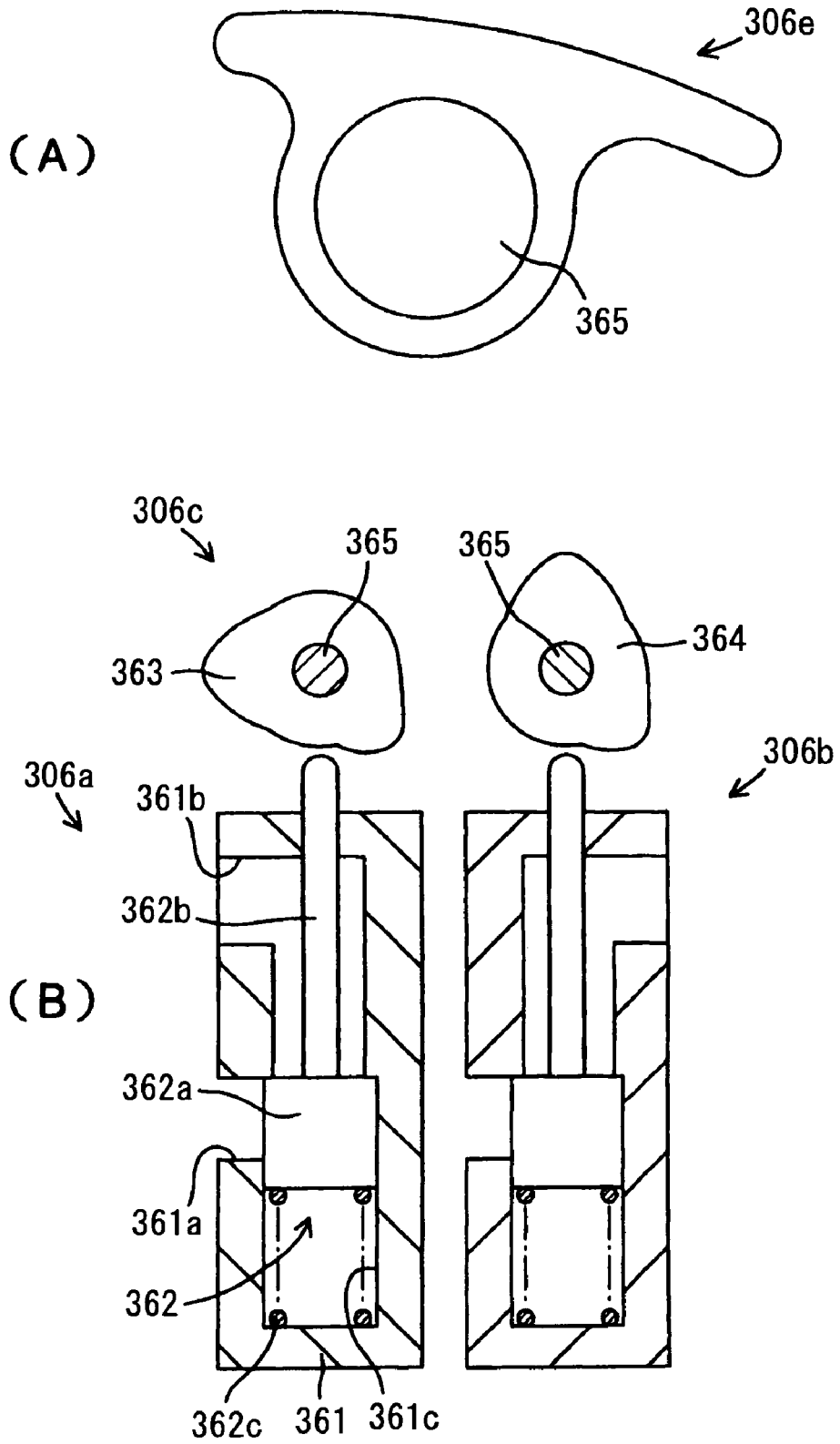
FIG. 16(A) is a side view of a manual handle when it is at "the origin" according to a tankless western-style flush toilet of an embodiment in the third invention.
FIG. 16(B) is a cross-sectional view of a rim open/close valve and the jet open/close valve and the like according to a tankless western-style flush toilet of an embodiment in the third invention.

At "original position" which is shown in FIG. 16, the manual handle 306*e* is in the condition of FIG. 16(A). Furthermore, as shown in FIG. 16(B), the rim open/close valve 306*a* and the jet open/close valve 306*b* are in the closed condition, so water a and water b are not spouted out.

Figure 17:
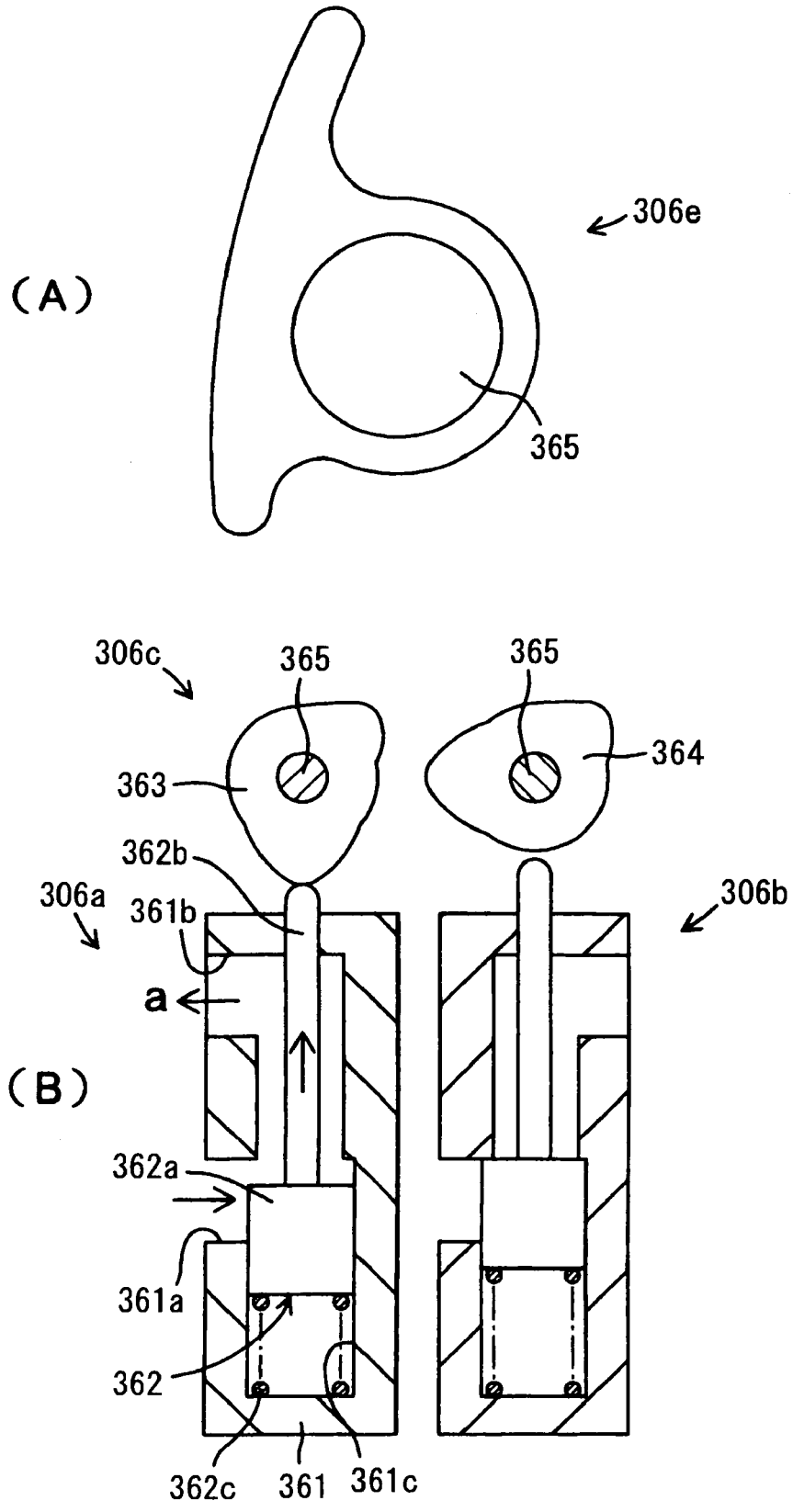
FIG. 17(A) is a side view of a manual handle when it is at "a rim washing position" according to a tankless western-style flush toilet of an embodiment in the third invention.
FIG. 17(B) is a cross-sectional view of a rim open/close valve and the jet open/close valve and the like according to a tankless western-style flush toilet of an embodiment in the third invention.

In addition, at "rim washing position" which is shown in FIG. 17, the manual handle 306*e* is in the condition of FIG. 17(A). Furthermore, as shown in FIG. 17(B), the rim open/close valve 306*a* is in the open condition, and water a is spouted out. On the contrary, the jet open/close valve 306*b* is in the closed condition, and water b is not spouted out.

Figure 18:
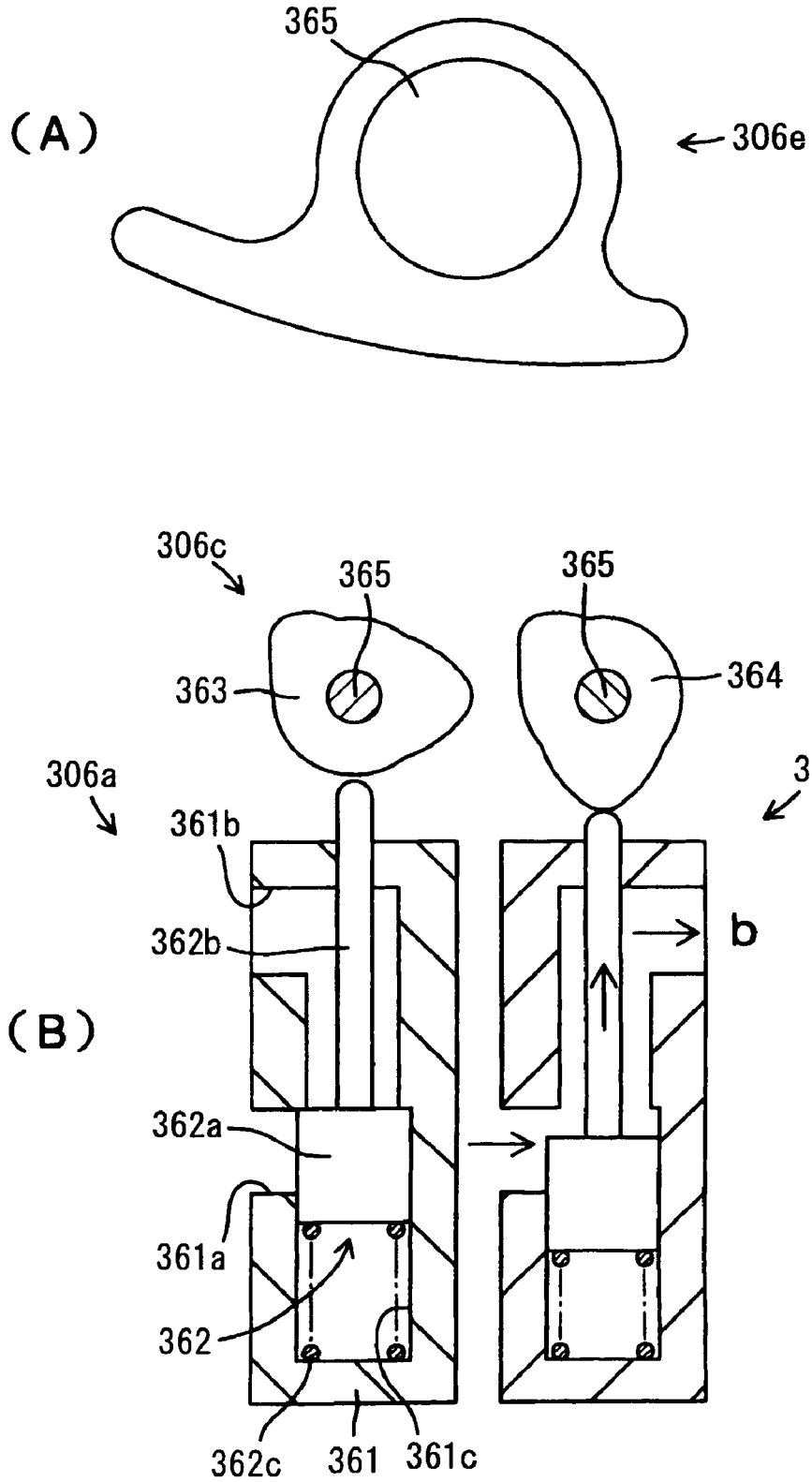
FIG. 18(A) is a side view of a manual handle when it is at "a jet washing position" according to a tankless western-style flush toilet of an embodiment in the third invention.
FIG. 18(B) is a cross-sectional view of a rim open/close valve and the jet open/close valve and the like according to a tankless western-style flush toilet of an embodiment in the third invention.

Besides, at "jet washing position" which is shown in FIG. 18, the manual handle 306*e* is in the condition of FIG. 18(A). Furthermore, as shown in FIG. 18(B), the rim open/close valve 306*a* is in the closed condition, and water a is not spouted out. On the contrary, the jet open/close valve 306*b* is in the open condition, and water b is spouted out.

In the tankless western-style flush toilet which is constituted as above, when the user makes a washing switch of the remote control 308 which is shown in FIG. 13 be in ON condition, the rim open/close valve 306*a* and the jet open/close valve 306*b* are controlled by the controller 307 in accordance with the following modes.

Figure 19:
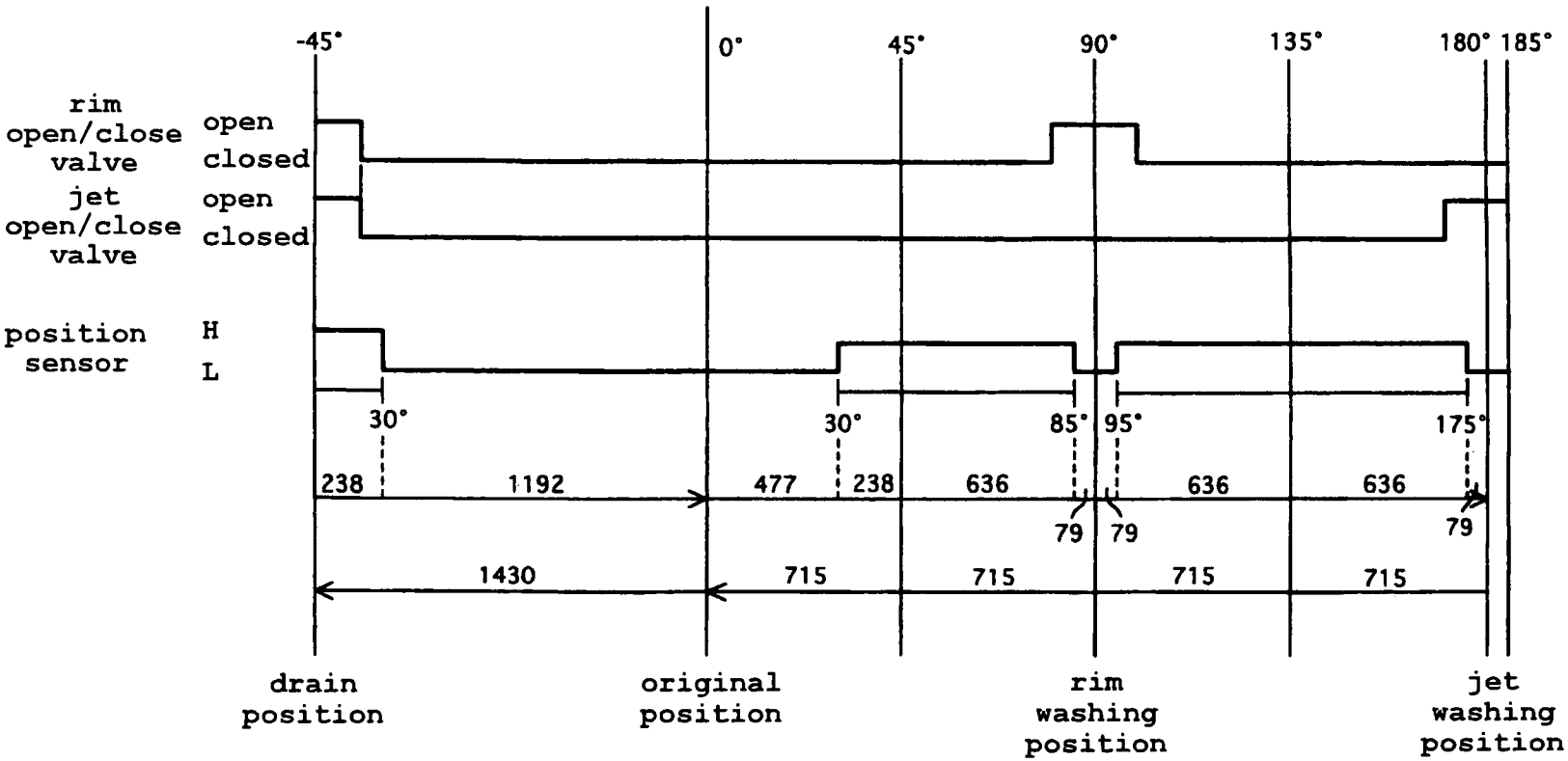
FIG. 19 is a view for showing the relationship between the number of a pulse count and the open and closed conditions of a rim open/close valve and a jet open/close valve.
Figure 20:
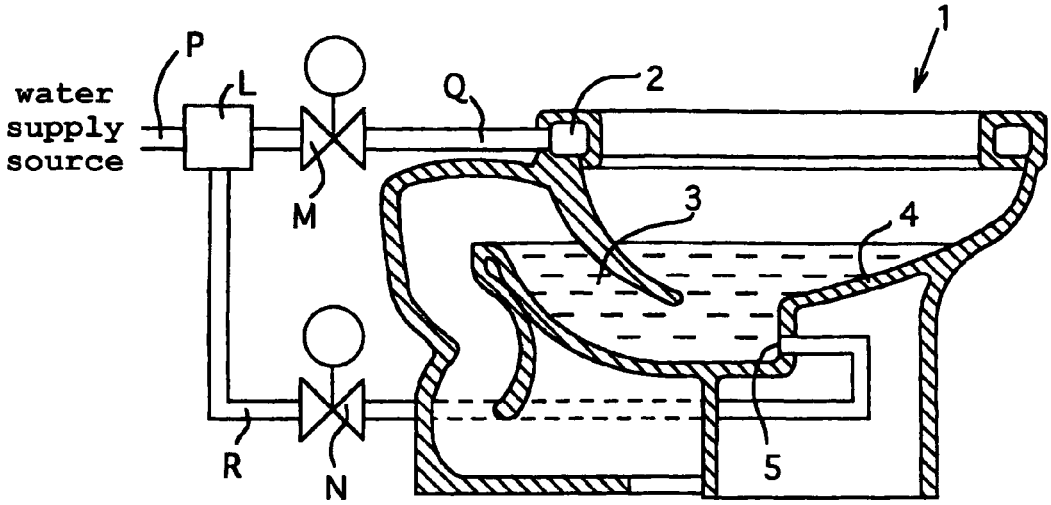
FIG. 20 is a side cross-sectional view for showing an outline constitution of a conventional forced siphon toilet.

When the initial condition is "original position" which is shown in FIG. 16, if the user makes the washing switch of the remote control 308 be in ON condition, as shown in FIG. 19, the stepping motor 306*d* begins to make a normal rotation, and the pulse count device 307*c* counts the pulse number of the stepping motor 306*d*. If the signal of the position sensor 307*b* is changed from a L signal to a H signal just when the pulse count device 307*c* counts 477 pulses, it is confirmed that the initial condition is "original position".

Then, the rim open/close valve 306*a* is released to be "rim washing position" which is shown in FIG. 17, and the signal of the position sensor 307*b* is changed from H signal to L signal just when the pulse count device 307*c* further counts 874 pulses, and after that, such a condition is maintained for a while. Furthermore, the signal of the position sensor 307*b* is changed from a L signal to a H signal just when the pulse count device 307*c* further counts 158 pulses, and after that, the rim open/close valve 306*a* is closed to finish "rim washing position".

After that, the stepping motor 306*d* further makes a normal rotation, and the jet open/close valve 306*b* is released to be "jet washing position" which is shown in FIG. 18. The signal of the position sensor 307*b* is changed from H signal to L signal just when the pulse count device 307*c* further counts 1272 pulses, and after that, the stepping motor 306*d* makes a reverse rotation before it reaches to around 185 degrees, and then, such a condition is maintained for a while. Furthermore, the signal of the position sensor 307*b* is changed from L signal to H signal just when the pulse count device 307*c* counts—79 pulses, and after that, the jet open/close valve 306*b* is closed to finish "jet washing position".

Moreover, the stepping motor 306*d* continues to make a reverse rotation, and the rim open/close valve 306*a* is released to be "rim washing position" which is shown in FIG. 17 again. The signal of the position sensor 307*b* is changed from H signal to L signal just when the pulse count device 307*c* further counts—1272 pulses, and after that, such a condition is maintained for a while. Furthermore, the signal of the position sensor 307*b* is changed from L signal to H signal just when the pulse count device 307*c* further counts—158 pulses, and after that, the rim open/close valve 306*a* is closed to finish "rim washing position". Accordingly, water sealing treatment of a trap is carried out.

Finally, the stepping motor 306*d* continues to make a reverse rotation, and the signal of the position sensor 307*b* is changed from H signal to L signal just when the pulse count device 307*c* further counts—874 pulses. Then, just when the pulse count device 307*c* further counts—477 pulses, the rim open/close valve 306*a* and the jet open/close valve 306*b* are at "original position" to be stopped. Accordingly, a washing process is finished.

Thus, in this tankless western-style flush toilet, the stepping motor 306*d* electrically drives the rim open/close valve 306*a* and the jet open/close valve 306*b*. During this, the position sensor 307*b* and the pulse count device 307*c* detect the condition of the rim open/close valve 306*a* and the jet open/close valve 306*b*, and the pulse generation circuit 307*d* and the like control the stepping motor 306*d* in the desired mode.

Besides, in this tankless western-style flush toilet, the rim open/close valve 306*a* and the jet open/close valve 306*b* are released in the semi-opened condition by operating the manual handle 306*e* manually. There is an assumption that, as shown in FIG. 15, in order to prevent the freezing during the winter season, the control person operates the manual handle 306*e* to make the rim open/close valve 306*a* and the jet open/close valve 306*b* be in the semi-opened condition, and at the same time, to make the stop cock be in the closed condition, and that the user makes the washing switch be in ON condition by opening the stop cock. In this case, the stepping motor 306*d* also begins to make a normal rotation as shown in FIG. 19, and the pulse count device 307*c* counts the pulse number of the stepping motor 306*d*. Then, the signal of the position sensor 307*b* is changed from H signal to L signal just when the pulse count device 307*c* counts 238 pulses, and the signal of the position sensor 307*b* is not changed from L signal to H signal just when the pulse count device 307*c* counts 477 pulses. Due to this, it is confirmed that the initial condition is "drain position".

Hereafter, the mode is changed in the order of "rim washing position", "jet washing position" and "rim washing position", and finally "original position" as above-described. After that, the stepping motor 306*d* continues to make a reverse rotation, and the signal of the position sensor 307*b* is changed from L signal to H signal just when the pulse count device 307*c* further counts—1192 pulses. The rim open/close valve 306*a* and the jet open/close valve 306*b* are in the semi-opened condition to be at "drain position", and they are stopped. Accordingly, a washing process is finished.

Thus, the pulse generation circuit 307*d* and the like return the rim open/close valve 361 and the jet open/close valve 306*b* to the initial condition even after the rim open/close valve 306*a* and the jet open/close valve 306*b* carry out the mode in the initial condition in which they are released by the manual handle 306*e*. Due to this, only if the stop cock is closed after the user uses the tankless western-style flush toilet, water which is reserved in the rim open/close valve 306*a* and the jet open/close valve 306*b* are discharged to the western-style toilet body 301, namely, draining is maintained. So, it is possible to exhibit the effect of the prevention of the freezing of the rim open/close valve 306*a* and the jet open/close valve 306*b*.

Therefore, in the tankless western-style flush toilet according to this embodiment, it is possible to achieve both of the control person's intention and the user's use.

The above-mentioned embodiments are only for illustrative purpose, and the first to third inventions can be carried out in modes including various modifications within a range without departing from the gist of the inventions.

INDUSTRIAL APPLICABILITY

Accordingly, in the western-style flush toilet of the first invention, it is possible to wash the western-style toilet body with excellent operability by the user who is not accustomed to this western-style flush toilet. In the flush toilet of the second invention, supplying water is automatically stopped, and water is not consumed wastefully. In the flush toilet of the third invention, it is possible to achieve both of the control person's intention and the user's use during the winter season.

The invention claimed is:

1. A western-style flush toilet comprising:

a western-style toilet body, an open/close valves a manual handle movable to release said open/close valve so as to wash said western-style toilet body, and a sensor configured to electrically detect a touch or a very small angle deviation mounted on the manual handle, wherein at least releasing said open/close valve is assisted by a detection signal from the sensor.

2. A flush toilet comprising:

a toilet body, and a toilet washing device configured to wash said toilet body with water and having an open/close valve configured to spout water by being opened and closed electrically, wherein said toilet washing device comprises a stepping motor configured to electrically drive the open/close valve, a position sensor configured to detect an abnormal condition of said open/close valve by a pulse frequency of the stepping motor, the pulse frequency corresponding to a rotation angle of the stepping motor, and a return means for positioning said open/close valve to a closed condition based on an abnormal signal from the position sensor.

3. A flush toilet according to claim 2, wherein said return means positions said open/close valve to the closed condition after carrying out at least a water sealing treatment on said toilet body.

4. A flush toilet comprising:

a toilet body, and a toilet washing device configured to wash said toilet body with water, wherein said toilet washing device comprises an open/close valve configured to spout water by being opened and closed, a stepping motor configured to electrically drive said open/close valve, a manual handle configured to release said open/close valve manually, a counting means for counting a pulse frequency of the stepping motor, a position sensor configured to detect a rotation angle of the stepping motor, and a control means for controlling the stepping motor on the basis of the counting means and the position sensor in a washing process for washing the toilet body, wherein the control means permits the open/close valve to be released by the manual handle, and controls the stepping motor so as to confirm an initial condition of the open/close valve at a time of starting the washing process and return the open/close valve to the initial condition before finishing the washing process.

* * * * *

UNITED STATES PATENT AND TRADEMARK OFFICE

CERTIFICATE OF CORRECTION

PATENT NO. : 7,069,604 B2
APPLICATION NO. : 10/910629
DATED : July 4, 2006
INVENTOR(S) : Tomita et al.

It is certified that error appears in the above-identified patent and that said Letters Patent is hereby corrected as shown below:

On the title page, Item (75), the inventors information is incorrect. Item (75) should read:

-- (75) Inventors: Katsunori Tomita, Aichi (JP); Kenichi Ito, Aichi (JP); Koji Miwa, Aichi (JP); Shingo Morikawa, Aichi (JP); Yasuhiro Shirai, Aichi (JP) --

Signed and Sealed this

Thirty-first Day of October, 2006

JON W. DUDAS
*Director of the United States Patent and Trademark Office*

UNITED STATES PATENT AND TRADEMARK OFFICE

CERTIFICATE OF CORRECTION

PATENT NO. : 7,069,604 B2
APPLICATION NO. : 10/910629
DATED : July 4, 2006
INVENTOR(S) : Katsunori Tomita et al.

It is certified that error appears in the above-identified patent and that said Letters Patent is hereby corrected as shown below:

Column 22, line 28, change “open/close valves” to -- open/close valve, --.

Signed and Sealed this

Twentieth Day of March, 2007

JON W. DUDAS
*Director of the United States Patent and Trademark Office*